US009239528B2

(12) United States Patent
Hasegawa et al.

(10) Patent No.: US 9,239,528 B2
(45) Date of Patent: Jan. 19, 2016

(54) TONER

(71) Applicant: CANON KABUSHIKI KAISHA, Tokyo (JP)

(72) Inventors: Yusuke Hasegawa, Suntou-gun (JP); Takashi Matsui, Mishima (JP); Shuichi Hiroko, Tokyo (JP); Yoshitaka Suzumura, Mishima (JP); Atsuhiko Ohmori, Suntou-gun (JP); Keisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 29 days.

(21) Appl. No.: 14/304,296

(22) Filed: Jun. 13, 2014

(65) Prior Publication Data

US 2014/0377696 A1 Dec. 25, 2014

(30) Foreign Application Priority Data

Jun. 24, 2013 (JP) ..... 2013-131695
May 16, 2014 (JP) ..... 2014-102124

(51) Int. Cl.
*G03G 9/08* (2006.01)
*G03G 9/097* (2006.01)
*G03G 9/087* (2006.01)

(52) U.S. Cl.
CPC ..... *G03G 9/0821* (2013.01); *G03G 9/08* (2013.01); *G03G 9/0804* (2013.01); *G03G 9/087* (2013.01); *G03G 9/0827* (2013.01); *G03G 9/09708* (2013.01); *G03G 9/09725* (2013.01)

(58) Field of Classification Search
CPC ..... G03G 9/09708; G03G 9/09725
USPC ..... 430/108.3, 108.6
See application file for complete search history.

(56) References Cited

U.S. PATENT DOCUMENTS

| | | | |
|---|---|---|---|
| 5,508,139 | A | 4/1996 | Tanaka et al. |
| 5,759,731 | A | 6/1998 | Hagi et al. |
| 6,586,151 | B1 | 7/2003 | Naka et al. |
| 2014/0030645 | A1 | 1/2014 | Nomura et al. |

FOREIGN PATENT DOCUMENTS

EP 2 192 448 A1 6/2010

(Continued)

OTHER PUBLICATIONS

European Search Report dated Nov. 24, 2014 in European Application No. 14171070.7.

*Primary Examiner* — Mark A Chapman
(74) *Attorney, Agent, or Firm* — Fitzpatrick, Cella, Harper and Scinto

(57) ABSTRACT

A toner comprising toner particles which comprise a binder resin and a colorant, and also inorganic fine particles as external additives, wherein the inorganic fine particles are silica fine particles and a group 2 element titanate fine particles, the inorganic fine particles have specific particle diameters, the silica fine particles have a coverage ratio X1 on the surfaces of the toner particles, which is not less than 40.0 surface area % and not more than 75.0 surface area %, when the theoretical coverage ratio by the silica fine particles is X2, the diffusion index defined as "diffusion index=X1/X2" satisfies the condition: diffusion index≥−0.0042×X1+0.62, and the external additives have an embedding ratio on the toner particles, which satisfies a specific range.

10 Claims, 4 Drawing Sheets

(56) References Cited

FOREIGN PATENT DOCUMENTS

| | | | |
|---|---|---|---|
| JP | 3385860 | B2 | 3/2003 |
| JP | 2008-276005 | A | 11/2008 |
| JP | 2009-186812 | A | 8/2009 |
| JP | 2009-229785 | A | 10/2009 |
| JP | 2010-60768 | A | 3/2010 |
| WO | 2013/115413 | A1 | 8/2013 |
| WO | 2014/002962 | A1 | 1/2014 |

TONER

BACKGROUND OF THE INVENTION

1. Field of the Invention

The present invention relates to a toner for use in, for example, electrophotographic, electrostatic recording and magnetic recording technologies.

2. Description of the Related Art

Conventionally, in electrophotographic systems, an electrostatic latent image bearing member (referred to below as a "photosensitive member") which is generally composed of a photoconductive material is charged by various means then exposed to light, thereby forming an electrostatic latent image on the surface of the photosensitive member. Next, the electrostatic latent image is developed with toner on a toner bearing member (referred to below as a "developing sleeve") to form a toner image, and the toner image is transferred to a transfer material such as paper, following which the toner image is fixed on the transfer material by heat, pressure or the application of both heat and pressure, yielding a copied article or a print. At this time, the toner that has not been transferred to the transfer material and remains on the photosensitive member following transfer (untransferred toner) is cleaned off by various methods, and the above steps are repeated.

One known cleaning system is a blade cleaning method that mechanically removes untransferred toner by pressing an elastic rubber blade against the photosensitive member.

In recent years, the desire for higher speed, higher image quality and smaller equipment size in copiers and printers which use electrophotographic technology has created a need to increase the process speed of the apparatus while at the same time furnishing high-resolution images. However, the burden on the toner increases at higher speeds, and problems relating to development performance, such as a decline in the image density caused by toner deterioration, have a tendency to arise.

Moreover, in the cleaning step, increasing the process speed of the apparatus makes it difficult for the cleaning blade to properly scrape away the toner, and allows toner to pass by the cleaning blade. As a result, what is referred to as "faulty cleaning" tends to arise.

A key technology in downsizing copiers and printers is to reduce the size of the developing sleeve. The application of charge to the toner is carried out by triboelectric charging due to rubbing between the toner and a triboelectric charge-providing member such as the developing sleeve in a region where the toner has been regulated primarily by a toner regulating member (referred to below as the "developing blade").

In the case of a smaller developing sleeve in particular, the developing zone of the development nip becomes smaller, making it more difficult for toner to jump from the developing sleeve. As a result, the phenomenon known as "charge-up" occurs in which only a portion of the toner becomes excessively charged, sometimes causing various image defects.

For example, the charged up toner remains on the developing sleeve, leading to a decrease in image density and making charging of the toner non-uniform, as a result of which image defects such as fogging in non-image regions sometimes arises.

In addition, the charged up toner tends to adhere strongly to the photosensitive member, making it difficult to remove in the cleaning step, which readily leads to faulty cleaning. Also, such toner has a tendency to pack tightly at the back of the cleaning blade, as a result of which the untransferred toner is not completely recovered, readily giving rise to the problem of waste toner spillage. Such problems can become quite serious, particularly in low-temperature, low-humidity environments where which toner charge-up readily occurs.

One method for improving the cleaning performance is to increase the pressure of the cleaning blade against the photosensitive member. However, simply increasing the blade pressure tends instead to give rise to such problems as vibration and curling of the cleaning blade. Also, from the standpoint of energy conservation, a low torque is preferred, and there are cases where a lower cleaning blade pressure is in fact preferred. Also, from a downsizing standpoint, because making the photosensitive member smaller increases the curvature at the surface of the photosensitive member, stable scraping with the cleaning blade becomes more difficult to achieve.

Toners in which an inorganic fine powder is externally added to the toner particles as an abrasive or a lubricant in order to improve the toner cleaning performance have also been proposed.

Japanese Patent No. 3385860 describes a toner obtained by the external addition to toner particles of strontium titanate fine particles that are sintered aggregates of primary particles having an average primary particle size of 30 to 150 nm.

However, with increasingly fine toner particles targeted at higher image quality, it becomes more difficult to obtain a stable image density. Moreover, because the state of attachment by silica and other inorganic fine particles is not controlled, this approach has not led to an improvement in cleaning performance within low-temperature, low-humidity environments.

When the diameter of a developing sleeve is made smaller, as mentioned above, charged up toner readily forms and toner charging tends to become uneven. In order for proper triboelectric charging of the overall toner to occur, toner circulation needs to take place in the region where rubbing with the developing sleeve and the developing blade is carried out (referred to below as the "blade nip"); that is, toner in contact with the developing sleeve or the developing blade must be replaced with toner that is not in contact. However, deteriorated toner has a poor ability to circulate, and so proper triboelectric charging of the overall toner tends to be difficult.

A great deal of research aimed at suppressing toner deterioration has hitherto been carried out.

Japanese Patent Application Laid-open No. 2009-186812 describes an emulsification aggregation toner for which the ratio of free large-particle-size silica (free ratio) has been specified. Japanese Patent Application Laid-open Nos. 2008-276005, 2010-60768 and 2009-229785 all describe technology for enabling toner to withstand long-term use by improving the attached state of the external additive and thereby altering toner flowability.

Such related art has indeed provided a certain degree of advantageous effects in terms of stability when used in durability tests and in terms of the cleaning performance. Yet, in cases where, as described above, the diameter of the developing sleeve has been made smaller, and also in low-temperature environments, satisfactory solutions have not been developed, leaving room for further improvement.

SUMMARY OF THE INVENTION

It is therefore an object of this invention to provide a toner which is able to resolve problems such as those described above.

More specifically, the object of this invention is to provide a toner which enables good images that have a stable image density and are free of fogging to be obtained regardless of the service environment, and which can suppress faulty cleaning and the occurrence of waste toner spillage even with downsizing of the image-forming apparatus and even under the conditions of use in a long-term durability test.

The inventors have discovered that the above challenges can be overcome by specifying the external addition state to toner for fine particles of a group 2 element titanate, such as strontium titanate fine particles, and silica fine particles.

Accordingly, the present invention provides a toner comprising toner particles comprising a binder resin and a colorant, and as external additives, inorganic fine particles A and inorganic fine particles B, wherein the inorganic fine particles A are group 2 element titanate fine particles which have a number-average particle diameter (D1) of primary particles thereof, which is not less than 60 nm and not more than 200 nm, the inorganic fine particles B are silica fine particles, the silica fine particles have a number-average particle diameter (D1) of primary particles thereof which is not less than 5 nm and not more than 20 nm, the silica fine particles have a coverage ratio X1 on surfaces of the toner particles, as determined with an x-ray photoelectron spectrometer (ESCA spectrometer), which is not less than 40.0 surface area % and not more than 75.0 surface area %, when the theoretical coverage ratio by the silica fine particles is X2, a diffusion index defined by Formula 1 below satisfies Formula 2 below:

$$\text{diffusion index}=X1/X2 \qquad \text{Formula 1}$$

$$\text{diffusion index}\geq -0.0042\times X1+0.62 \qquad \text{Formula 2}$$

and the external additives have an embedding ratio on the toner particles, which is not less than 25% and not more than 60%.

The toner of this invention makes it possible to obtain good images which, regardless of the service environment, have a stable image density and are free of fogging. Moreover, the inventive toner is able to suppress faulty cleaning and the occurrence of waste toner spillage, even when the image-forming apparatus has been downsized and even under the conditions of use in a long-term durability test.

Further features of the present invention will become apparent from the following description of exemplary embodiments (with reference to the attached drawings).

DESCRIPTION OF THE EMBODIMENTS

Figure 1:
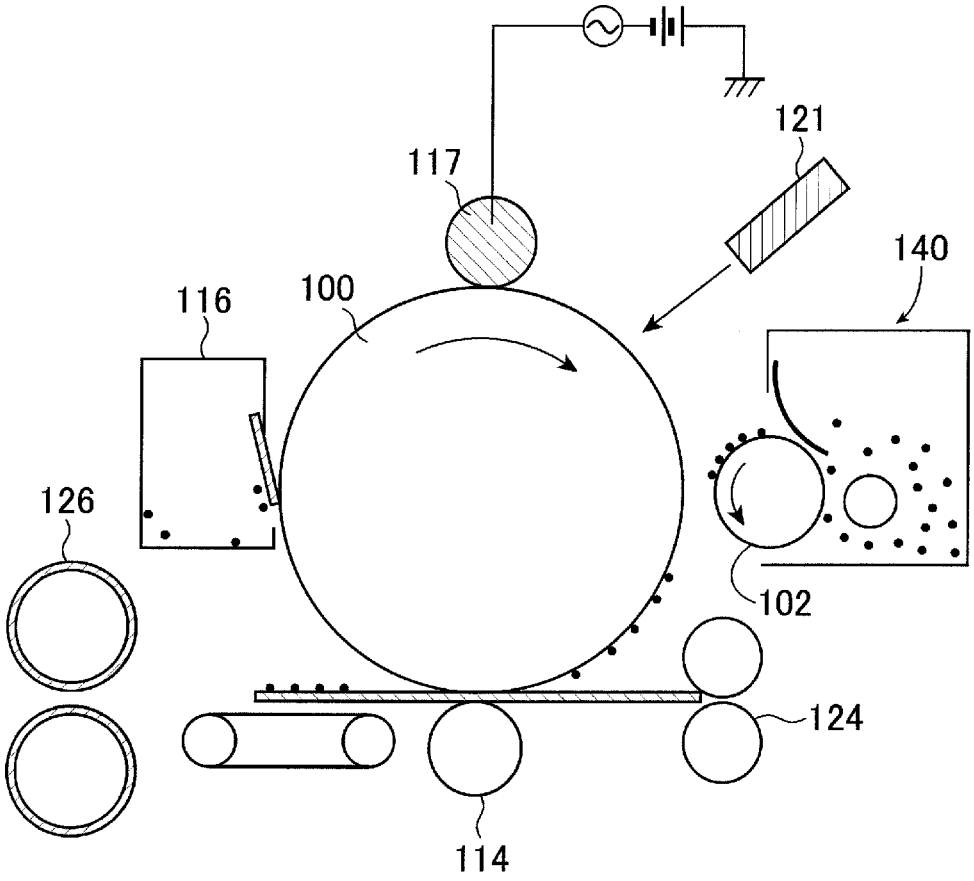
FIG. 1 is a diagram showing an example of an image-forming apparatus.

As explained above, the present invention provides a toner made up of toner particles which contain a binder resin and a colorant, and also, as external additives, inorganic fine particles A and inorganic fine particles B. The inorganic fine particles A are fine particles of a group 2 element titanate which have a number-average particle diameter (D1) of primary particles thereof, which is not less than 60 nm and not more than 200 nm. The inorganic fine particles B are fine particles of silica which have a number-average particle diameter (D1) of primary particles thereof, which is not less than 5 nm and not more than 20 nm. The coverage ratio X1 by the silica fine particles on surfaces of the toner particles, as determined with an x-ray photoelectron spectrometer (ESCA spectrometer), is not less than 40.0 surface area % and not more than 75.0 surface area %. When the theoretical coverage ratio by the silica fine particles is X2, a diffusion index defined by Formula 1 below satisfies Formula 2 below:

$$\text{diffusion index}=X1/X2 \qquad \text{Formula 1}$$

$$\text{diffusion index}\geq -0.0042\times X1+0.62 \qquad \text{Formula 2}$$

The external additives have an embedding ratio on the toner particles, which is not less than 25% and not more than 60%.

According to investigations by the inventors, by using such a toner, good images which have a stable image density and are free of fogging can be obtained regardless of the service environment. Moreover, faulty cleaning and the occurrence of waste toner spillage can be suppressed.

The problems of faulty cleaning and waste toner spillage are thought to arise from the following causes.

In a long-term durability test, the toner incurs stress from rubbing by the blade nip and the external additive becomes embedded, giving rise to toner deterioration characterized by a marked difference in toner properties such as flowability between an early stage and a late stage in durable use. Also, in cases where, due to downsizing of the apparatus, the diameter of the developing sleeve has been made smaller, charged-up toner readily forms, which tends to make charging non-uniform.

Not only does this tend to give rise to the image defect known as "fogging" of non-image areas, various other problems readily occur due to an increase in adhesion between the toner and other members. For example, because the charged-up toner remains on the developing sleeve, the image density tends to decrease.

Moreover, as mentioned above, because the toner that has incurred stress and deteriorated with use under long-term durable use conditions has a poor flowability, toner circulation within the blade nip worsens. This makes proper triboelectric charging of the overall toner difficult and, when development is carried out after the toner has been left standing for a while, the amount of untransferred toner tends to increase.

Because adhesion to the photosensitive member increases at this time, the charged up toner is difficult to remove in the cleaning step. Hence, toner passes by the cleaning blade, and faulty cleaning tends to arise.

Also, when the toner is charged up, even if the toner can be recovered well by the blades, the toner tends to pack tightly near the entrance to the receptacle that holds the untransferred toner (the waste toner receptacle). When this happens, recovery of the untransferred toner into the waste toner receptacle becomes impossible, and the problem referred to herein as "waste toner spillage" tends to arise.

These problems are particularly egregious in low-temperature, low-humidity environments where the toner has a tendency to charge up.

In order to avoid causing such problems, it is important to suppress toner deterioration, to suppress at the same time toner charge-up, and also to reduce adhesion between the photosensitive member and the toner.

To this end, it is important first of all to include, as an external additive, silica fine particles having a number-average particle diameter (D1) of primary particles thereof which is not less than 5 nm and not more than 20 nm, and to set the coverage ratio X1 by the silica fine particles to not less than 40.0 surface area % and not more than 75.0 surface area %. In addition, when the theoretical coverage ratio is X2, it is important to control the diffusion index (=X1/X2) in a specific range.

The number-average particle diameter of primary particles of the silica fine particles is preferably not less than 5 nm and not more than 15 nm, and more preferably not less than 7 nm and not more than 15 nm. The coverage ratio X1 is preferably not less than 45.0 surface area % and not more than 70.0 surface area %, and more preferably not less than 45.0 surface area % and not more than 68.0 surface area %.

Here, at a coverage ratio X1 below 40.0 surface area %, the intended effects of the invention are not obtained. A coverage ratio X1 greater than 75.0 surface area % hinders the low temperature fixability.

By controlling the coverage ratio X1 and the diffusion index in the above way, it is possible to greatly suppress toner deterioration with long-term use of the toner in a durability test.

The primary particle diameter of the silica fine particles is relatively small. However, at a number-average particle diameter of the primary particles of less than 5 nm, the silica fine particles readily agglomerate with each other and, even at the surfaces of the toner particles, tend to exist as agglomerates. When the silica fine particles are present as agglomerates, with repeated use in a durability test, rubbing between the toner particles causes the silica fine particles to break up and readily detach from the surfaces of the toner particles.

Hence, even if the silica fine particles are added in such a way as to adjust the coverage ratio X1 early during use in a durability test, the coverage ratio by the silica fine particles decreases at a late stage of use in the durability test. Moreover, because these particles are present in the form of agglomerates, owing to forces between the silica fine particles, a larger number of silica fine particles tend to become buried in the toner. Hence, the toner properties differ greatly between early use in a durability test and late use in the test, and so toner deterioration tends to arise.

At a number-average particle diameter of primary particles of the silica fine particles larger than 20 nm, satisfying the value of the coverage ratio X1 requires the addition of a large amount of silica fine particles. When this is done, the silica fine particles tend to agglomerate, making the diffusion index and the embedding ratio very difficult to control.

In this invention, by simultaneously controlling the coverage ratio X1 and the diffusion index, it is possible to uniformly diffuse to a high degree the silica fine particles on the surface of the toner particles.

In this case, because the silica fine particles adhere to the surface of the toner particles in a state that is closer to that of primary particles, the silica fine particles do not readily detach from the surface of the toner particles even when a durability test is carried out. Moreover, because they have not agglomerated, the likelihood of silica fine particles being in mutual contact decreases, and in addition, it is also possible to keep the silica fine particles from being readily buried in the toner particles owing to the forces between the silica fine particles.

In this invention, it is also important for the embedding ratio of the external additives in the toner particles to be not less than 25% and not more than 60%. The embedding ratio is preferably not less than 30% and not more than 55%. As explained above, only after controlling the coverage ratio and the diffusion index and inducing the embedding ratio to be within the above range, adhesion between the photosensitive member and the toner can be reduced.

The reasons for this are not entirely clear, although the inventors suspect the following to the case.

In order to reduce adhesive forces between the photosensitive member and the toner, it is very important that an external additive in the form of inorganic fine particles be present between the photosensitive member and the toner particles. As mentioned above, by having an external additive that is uniformly dispersed to a high degree embedded in some specific state, it is thought that the surface state of the toner particles becomes more uniform. As a result, when the toner and the photosensitive member come into contact, the probability of external agent being present therebetween can be maximized, presumably enabling adhesion between the toner and the photosensitive member to be reduced.

For example, even if only the embedding ratio has been controlled in the state of an agglomerate, some portion of the external additive in the agglomerate will be completely buried and some other portion of the external additive will be present without being buried whatsoever.

Should the unburied portion of the external additive move at the surface of the toner particles, portions of the toner to which external additive is not attached become exposed and the probability of their coming into direct contact with the photosensitive member increases. As a result, adhesion between the photosensitive member and the toner cannot be lowered.

Also, even if, as in this invention, the toner has not less than a given coverage ratio and the diffusion index is in a controlled state, in cases where the external additive embedding ratio is less than 25%, when shear acts upon the toner during use in a durability test, the external additive readily detaches and areas of the toner particles which come into direct contact with the photosensitive member emerge.

Conversely, in cases where the external active embedding ratio exceeds 60%, the toner circulation tends to decrease. Once an area where toner particles come into direct contact with the photosensitive member has arisen, the toner does not roll and external additive cannot come between the toner and the photosensitive member, which may make it difficult for the toner to separate from the photosensitive member.

The coverage ratio and the diffusion index will be described in detail later.

It is important for the inventive toner to contain, as the inorganic fine particles A, fine particles of a group 2 element titanate such as strontium titanate fine particles, and for the number-average particle diameter of primary particles thereof to be in a specific range.

The inventors have found that the addition, with the silica fine particles in a highly uniformly dispersed state, of fine particles of a group 2 element titanate having a particle diameter in a specific range enables the fine particles of the group 2 element titanate to be uniformly dispersed to a high degree at the surface of the toner particles. As a result, the inventors discovered at the same time that toner charge-up suppressing effects by the fine particles of the group 2 element titanate can be fully elicited.

In particular, when the silica fine particles are in the state of an agglomerate, the silica fine particles will, for example, attach to the periphery of the fine particles of the group 2 element titanate, making it difficult to fully elicit the toner charge-up suppressing effects. As noted above, by uniformly diffusing to a high degree two types of inorganic fine particles, the fine particles of the group 2 element titanate attach to the surface of the toner particles in a highly uniformly diffused state, and so charge-up can be effectively suppressed. Hence, even in image formation using a developing sleeve of a smaller diameter and after letting the apparatus stand in a low-temperature, low-humidity environment following long-term use in a durability test, it becomes possible to properly charge the overall toner, and so the amount of untransferred toner tends to decrease.

In such a case, the charge-up suppressing effect can be fully manifested, and problems caused by toner charge-up can be suppressed.

Only by simultaneously controlling the coverage ratio, the diffusion index and also the embedding ratio for the external additive, it is possible to suppress toner deterioration, suppress at the same time charge-up, and moreover reduce adhesion between the photosensitive member and the toner, thus enabling the problems described above to be resolved.

In this invention, it is important for the fine particles of the group 2 element salt titanate which is added to have a number-average particle diameter (D1) of primary particles thereof which is not less than 60 nm and not more than 200 nm. This is preferably not less than 80 nm and not more than 150 nm. In this range, the fine particles of the group 2 element salt titanate readily attach in the form of primary particles to the surface of the toner particles, thus making it easier to control the embedding ratio of the external additive. Moreover, even in durability tests, they do not readily detach, enabling charge-up suppressing effects to be readily obtained.

At less than 60 nm, the charge adjustment effects as a microcarrier are not adequately obtained. On the other hand, at a number-average particle diameter larger than 200 nm, the fine particles of the group 2 element titanate readily detach from the surface of the toner particles, and an adequate charge-up suppressing effect is unlikely to be obtained.

As used herein, "group 2 element" refers to an element (typical element) belonging to group 2 of the Periodic Table. Group 2 elements include beryllium, magnesium, calcium, strontium, barium and radium. Of these, calcium, strontium, barium, and radium are also called alkaline earth metals. Illustrative examples of the fine particles of the group 2 element salt of titanic acid include beryllium titanate fine particles, magnesium titanate fine particles, calcium titanate fine particles, strontium titanate fine particles, barium titanate fine particles and radium titanate fine particles. Of these, strontium titanate fine particles are preferred on account of their excellent toner charge-up suppressing effect.

The binder resin according to this invention tends to have a high negative charging performance. On the other hand, because this group 2 element salt titanate has a relatively weak positive charging performance, the toner charge-up suppressing effect is excellent.

In cases where strontium titanate fine particles are used as the fine particles of the group 2 element titanate, use can be made of, more preferably, strontium titanate fine particles having a particle shape that is cubic and/or cuboid, and having a perovskite-type crystalline structure.

Strontium titanate fine particles having a particle shape that is cubic and/or cuboid, and having a perovskite-type crystalline structure are primarily produced within an aqueous medium without passing through a sintering step. For this reason, control to a uniform particle diameter is easy, making use in this invention desirable. That is, fine particles of the group 2 element titanate which can easily be controlled in this way to a uniform particle diameter attach more uniformly to the toner and are able to remain on the surface of the toner particles in a difficult-to-detach state.

Confirmation that the crystal structure of the fine particles of the group 2 element titanate is a perovskite structure (a face-centered cubic lattice composed of three differing elements) can be carried out by x-ray diffraction measurement.

In the practice of this invention, taking into account the developing characteristics, and also from the standpoint of being able to control the triboelectric charging characteristics and the triboelectric charge quantity due to the environment, it is preferable for the fine particles of the group 2 element titanate be surface-treated.

Illustrative examples of the surface treatment agent include treatment agents such as fatty acids, fatty acid metal salts and organosilane compounds.

By carrying out surface treatment, in the case of, for example, a coupling agent which is a compound having a hydrophilic group and a hydrophobic group, because the hydrophilic group side covers the surface of the group 2 element titanate fine particles and the hydrophobic group side is positioned on the outside, the fine particles of the group 2 element titanate undergo hydrophobic treatment. In this way, fluctuations in the triboelectric charge quantity due to the environment can be suppressed. With a coupling agent in which functional groups such as amino groups and fluorine have been introduced, control of the triboelectric charge quantity is easily achieved and the advantageous effects of the invention can be more easily manifested.

Moreover, in the case of a surface treatment agent like that described above, given that surface treatment takes place at the molecular level, the shape of the fine particles of the group 2 element titanate remains substantially unchanged. This is all the more desirable because the scraping forces due to the substantially cubic or cuboid shape are maintained.

The surface treatment agent is exemplified by titanate coupling agents, aluminum-based coupling agents and silane coupling agents. Examples of fatty acid metal salts include zinc stearate, sodium stearate, calcium stearate, zinc laurate, aluminum stearate and magnesium stearate. Similar effects can be obtained even with, for example, stearic acid, which is a fatty acid.

The treatment method is exemplified by a wet method that involves dissolving and dispersing in a solvent the surface treatment agent to be used for treatment, adding thereto the group 2 element titanate fine particles, and carrying out treatment by removing the solvent under stirring. Another exemplary treatment method is a dry method which involves directly mixing together a coupling agent, a fatty acid metal salt and group 2 element titanate fine particles, and carrying out treatment under stirring.

With regard to surface treatment, there is no need to completely treat and cover the fine particles of the group 2 element titanate; the group 2 element titanate fine particles may remain exposed within a range where the desirable effects of the invention are attainable. That is, surface treatment may be discontinuously formed.

In addition, it is preferable for the free ratio of the fine particles of the group 2 element titanate to be not less than 20% and not more than 70%. The free ratio is more preferably not less than 30% and not more than 60%. At a free ratio within this range, the fine particles are able to function as suitable microcarriers and can manifest a charge-up suppressing effect.

When the free ratio is less than 20%, the effects as a microcarrier tend to be inadequate, and uniform charging of the overall toner tends to be difficult.

In cases where the free ratio exceeds 70%, the charge-up suppressing effect tends to be inadequate, and the effect of reducing adhesion to functional members of the apparatus has a tendency to decline.

The method of measuring the free ratio of the fine particles of the group 2 element titanate will be subsequently described in detail, although it should be noted that this is the free ratio when the fine particles have been semi-forcibly freed in an aqueous solution. Because both the silica fine particles and the fine particles of the group 2 element titanate contribute to the above-described external additive embedding ratio, the free ratio of the fine particles of the group 2 element titanate does not relate directly to the external additive embedding ratio. The inventors have found that the charge-up suppressing effect by the fine particles of the group 2 element titanate is more readily controlled by the free ratio of the fine particles of the group 2 element titanate than by the external additive embedding ratio.

This appears to be because the free ratio which detects the attached state of group 2 element titanate fine particles that act directly as microcarriers correlates better with the charge-up suppressing effect than does the attached state of silica fine particles and group 2 element titanate fine particles which contributes to the external additive embedding ratio.

Moreover, in the practice of this invention, to fully elicit the action as microcarriers and the charge-up suppressing effect that are described above, it is preferable for the group 2 element titanate fine particles to be included in an amount of not less than 0.1 mass part and not more than 1.0 mass part per 100 mass parts of the toner particles. An amount of not less than 0.1 mass part and not more than 0.6 mass part is more preferred.

Even when a somewhat large amount of the group 2 element titanate fine particles is included, a sufficient charge-up suppressing effect is difficult to elicit if the free ratio is high.

Ways of controlling the free ratio of group 2 element titanate fine particles within the above range include, for example, adjusting the power during external addition and mixing treatment, and adjusting the treatment time. The free ratio can be raised by lowering the power during external addition and mixing treatment or shortening the treatment time. The free ratio can be lowered by increasing the power during external addition and mixing treatment or by lengthening the treatment time.

In the practice of this invention, as described above, by controlling the coverage ratio and the diffusion index, it is possible to suppress toner deterioration. By way of illustration, when the number of printed pages has been increased by, for example, increasing the amount of toner loaded into the toner cartridge, this sometimes gives rise to toner deterioration.

To properly carry out, even in cases where toner deterioration has occurred, the uniform charging and the charge-up suppression that have hitherto been described, it is important that the toner easily disaggregate so that rubbing at the blade nip is carried out for each individual particle even late during use in a durability test.

This phenomenon of the toner readily disaggregating into individual particles even when it has deteriorated is closely related to the above-described coverage ratio and diffusion index.

Next, the "silica fine particle external addition state" in the toner of this invention is specified as follows.

The toner of the invention is characterized in that the coverage ratio X1 by silica fine particles on the surfaces of the toner particles, as determined with an x-ray photoelectron spectrometer (ESCA spectrometer), is not less than 40.0 surface area % and not more than 75.0 surface area %. The toner of the invention is also characterized in that, when the theoretical coverage ratio by silica fine particles is X2, the diffusion index defined by Formula 1 below satisfies Formula 2 below:

$$\text{Diffusion Index}=X1/X2; \qquad \text{Formula 1}$$

and $$\text{Diffusion Index}\geq -0.0042\times X1+0.62. \qquad \text{Formula 2}$$

The above coverage ratio X1 can be calculated from the ratio of the detected intensity of elemental silicon when the toner is measured by ESCA relative to the detected intensity of elemental silicon when silica fine particles alone are measured. This coverage ratio X1 indicates the ratio of the surface area of the toner particles which is actually covered by silica fine particles.

When the coverage ratio X1 is not less than 40.0 surface area % and not more than 75.0 surface area %, the flowability and charging performance of the toner can be controlled in a good state throughout use in a durability test. When the coverage ratio X1 is less than 40.0 surface area %, the subsequently described ease of toner disaggregation cannot be adequately achieved. For this reason, depending on the evaluation conditions and environment, the toner readily deteriorates and flowability worsens.

The theoretical coverage ratio X2 by the silica fine particles is calculated from Formula (4) below using, for example, the number of mass parts of silica fine particles per 100 mass parts of the toner particles, and the diameter of the silica fine particles. This indicates the proportion of the surface area of the toner particle surfaces that can be theoretically covered.

$$\text{Theoretical coverage ratio } X2(\text{surface area }\%)=3^{1/2}/(2\pi)\times(dt/da)\times(\rho t/\rho a)\times C\times 100 \qquad \text{Formula 4}$$

where da: number-average particle diameter (nm) of silica fine particles (D1)

dt: weight-average particle diameter of toner (D4)

ρa: true specific gravity of silica fine particles

ρt: true specific gravity of toner

C: mass of silica fine particles/mass of toner (=number of mass parts of silica fine particles/(number of mass parts of silica fine particles+100))

(The subsequently described content of silica fine particles in the toner is used as C.)

The external additive embedding ratio is calculated from the following formula.

$$\text{External additive embedding ratio}(\%)=100-(Bt-Bm)/Br\times 100 \qquad \text{Formula 5}$$

where Bt: BET of toner

Bm: BET of toner particles

Br: BET theoretical value that rises when external additive alone is added to toner (BET here refers to the specific surface area ($m^2/g$) measured by the BET method using nitrogen adsorption)

$$Br=[(BET\text{ of External Additive }1(B1)\times\text{number of mass parts of External Additive }1/100)+(BET\text{ of External Additive }2(B2)\times\text{number of mass parts of External Additive }2/100)+\ldots((BET\text{ of External Additive }n(Bn)\times\text{number of mass parts of External Additive }n/100)) \qquad \text{Formula 6}$$

(For example, when silica fine particles and strontium titanate fine particles are used as the external additives, their respective BET's and numbers of mass parts are used for External Additives 1 and 2.)

Measurement of the specific surface area of the external additive measured by the BET method using nitrogen adsorption is carried out in accordance with JIS Z 8830 (2001). The measuring apparatus will be described later.

The physical significance of the diffusion index shown in Formula 1 above is described below.

The diffusion index represents the divergence between the measured coverage ratio X1 and the theoretical coverage ratio X2. The degree of this divergence is thought to indicate how many fine particles of silica are stacked two or three layers in the vertical direction from the surface of the toner particles. Ideally the diffusion index is 1, but this is a case in which the coverage ratio X1 agrees with the theoretical coverage ratio X2, and is a state where there exist no silica fine particles whatsoever stacked two or more layers. On the other hand, when the silica fine particles are present on the surface of toner particles as agglomerates, a divergence arises between the measured coverage ratio and the theoretical coverage ratio, resulting in a smaller diffusion index. Hence, the diffusion index can also be said to indicate the amount of silica fine particles that exists as agglomerates.

In this invention, it is important for the diffusion index to be in the range indicated by above Formula 2, which range is thought to be larger than that of conventionally manufactured toners. A large diffusion index indicates that, of the silica fine particles on the surface of the toner particles, the amount present as agglomerates is small, and the amount present as primary particles is large. As mentioned above, the upper limit in the diffusion index is 1.

The inventors have found that, in cases where the coverage ratio X1 and the range in the diffusion index shown in Formula 2 are both satisfied, the ease of toner disaggregation under the application of pressure can greatly improve.

To date, it has been understood that the ease of toner disaggregation can be enhanced further by raising the coverage ratio X1 through an increased use of external additives having a particle diameter of nano-meter size. On the other hand, it became apparent from investigations by the inventors that, on measuring the ease of disaggregation by toners which had the same coverage ratio X1 but differing diffusion indices, a difference arises in the ease of toner disaggregation. In addition, it was discovered that when the ease of disaggregation is measured while pressure is being applied, an even more striking difference can be observed.

In particular, the inventors think that it is the ease of toner disaggregation under the application of pressure that further reflects the toner behavior at the blade nip. Hence, the inventors believe that, to more tightly control the ease of disaggregation by toner under applied pressure, in addition to the coverage ratio X1, the diffusion index is also very important.

The reason why the toner has a good ease of disaggregation when the coverage ratio X1 and the range in the diffusion index shown in Formula 2 are both satisfied is not well understood, but the inventors believe this to be as follows.

The cause is thought to be that, when the toner is present in a narrow, high-pressure place such as the blade nip, the toner particles readily enter into an "interlocked" state so that the particles of external additive present on the surfaces thereof do not collide with one another. At this time, when many silica fine particles are present as agglomerates, the influence of interlocking becomes too large, making it difficult to rapidly separate the toner particles.

In particular, when the toner has deteriorated, the silica fine particles end up being buried on the surface of the toner particles, lowering the toner flowability. At that time, the influence of interlocking between silica fine particles present as agglomerates which are not buried becomes larger, presumably impeding the ease of toner disaggregation.

In the toner of the invention, because many silica fine particles are present as primary particles, even when the toner has deteriorated, interlocking between toner particles does not readily arise and the toner, when rubbed by the blade nip, very readily disaggregates into individual particles. That is, it has become possible to dramatically improve the ease of toner disaggregation which was difficult to achieve simply by conventional control of the coverage ratio X1.

Hence, with conventional toners, the toner that has deteriorated after incurring stress has a poor ability to circulate within the blade nip, making it difficult for all of the toner to be properly triboelectrically charged, so that the amount of untransferred toner tends to become large. However, in the inventive toner, this problem has been resolved.

That is, in the toner of the invention, at the same time that deterioration is suppressed, even when deterioration has taken place, because the ease of toner disaggregation can be maintained and, simultaneously, adhesive forces with, for example, the development blade and the developing sleeve are reduced, the toner circulates well within the blade nip.

As a result, all of the toner is properly charged, making it possible to greatly improve the problems associated with non-uniform charging and charge-up.

The boundary line for the diffusion index in the invention, within the range in the coverage ratio X1 of not less than 40.0 surface area % and not more than 75.0 surface area %, is a function of the coverage ratio X1 as the variable. This function was empirically obtained from the phenomenon where, when the coverage ratio X1 and the diffusion index are obtained by varying, for example, the silica fine particles and the external addition conditions, the toner easily and fully disaggregates upon the application of pressure.

Figure 2:
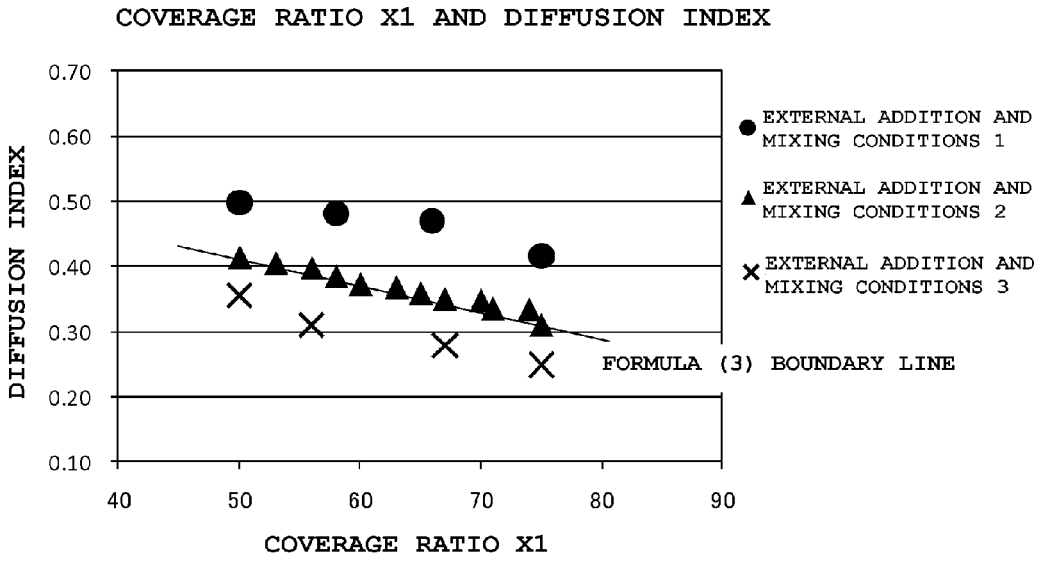
FIG. 2 is a diagram showing the boundary line of the diffusion index.

FIG. 2 is a graph which plots the relationship between the coverage ratio X1 and the diffusion index when toners having coverage rates X1, which were varied preferably, were manufactured by using three different external addition and mixing conditions and varying the amount of silica fine particles added. Of the toners plotted in this graph, the ease of toner disaggregation upon the application of pressure was found to improve sufficiently for toners plotted in the region which satisfies Formula 2.

The reason why the diffusion index is dependent on the coverage ratio X1 is not well understood, although the inventors suspect this to be as follows. To ease toner disaggregation upon the application of pressure improves, it is preferable for the amount of silica fine particles present as secondary particles to be small, although the influence by the coverage ratio X1 also is not insignificant. As the coverage ratio X1 increases, toner disaggregation gradually becomes easier, and so the permissible amount of silica fine particles present as secondary particles increases. In this way, the boundary line of the diffusion index is thought to become a function of the coverage ratio X1 as the variable. That is, a correlation exists between the coverage ratio X1 and the diffusion index and, as noted above, the importance of controlling the diffusion index in accordance with the coverage ratio X1 has been experimentally ascertained.

When the diffusion index is in the range of Formula 3 indicated below, the amount of silica fine particles present as agglomerates increases, toner deterioration cannot easily be suppressed and sufficiently improving the ease of toner disaggregation is difficult. As a result, the intended effects of the invention cannot be fully achieved.

$$\text{diffusion index} < -0.0042 \times X1 + 0.62 \qquad \text{Formula 3}$$

As explained above, the inventors think that the reason why the occurrence of faulty cleaning and waste toner spillage can be suppressed even in a low-temperature, low-humidity environment has to do with the effects of controlling the external addition state, including the coverage ratio, diffusion index and embedding ratio, in combination with effects arising from the fine particles of a specific group 2 element titanate.

Binder resins that may be used in the invention include vinyl resins, polyester resins, epoxy resins and polyurethane resins. These conventional known resins may be used without particular limitation. Of these, from the standpoint of both the charging performance and the fixing performance, including a polyester resin or a vinyl resin is preferred.

Exemplary polymerizable monomers of polyester resins, and the compositions of such resins, are described below.

Examples of divalent alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and hydrogenated bisphenol A; bisphenols of formula (A) below and derivatives thereof

[C1]

(A)

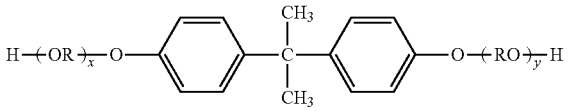

(wherein R is an ethylene or propylene group; and x and y are each integers ≥0, with the proviso that the average value of x+y is from 0 to 10); a diol of formula (B) below

[C2]

(B)

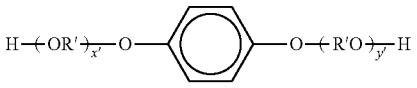

(wherein R' is —$CH_2CH_2$—,

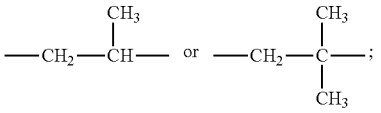

and x' and y' are integers ≥0, with the proviso that the average value of x'+y' is from 0 to 10).

Divalent acid components are exemplified by the following dicarboxylic acids and their derivatives: benzenedicarboxylic acids such as phthalic acid, terephthalic acid, isophthalic acid and phthalic anhydride, and anhydrides and lower alkyl esters thereof; alkyldicarboxylic acids such as succinic acid, adipic acid, sebacic acid and azelaic acid, and anhydrides and lower alkyl esters thereof; alkenylsuccinic acids and alkylsuccinic acids such as n-dodecenylsuccinic acid and n-dodecylsuccinic acid, and anhydrides and lower alkyl esters thereof; and unsaturated dicarboxylic acids such as fumaric acid, maleic acid, citraconic acid and itaconic acid, and anhydrides and lower alkyl esters thereof.

Alcohol components having a functionality of 3 or more and acid components having a functionality of 3 or more that function as crosslinking components may be used singly or in combination.

Illustrative examples of polyvalent alcohol components having a functionality of 3 or more include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane and 1,3,5-trihydroxybenzene.

Illustrative examples of polyvalent carboxylic acid components having a functionality of 3 or more that may be used in the invention include the following polycarboxylic acids and derivatives thereof: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid and Empol® trimer acids, as well as anhydrides and lower alkyl esters thereof; tetracarboxylic acids of the following formula

[C3]

(C)

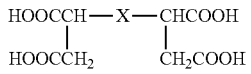

(wherein X is a $C_{5-30}$ alkylene or alkenylene group having one or more side chain of carbon number of 3 or more), as well as anhydrides and lower alkyl esters thereof.

The content of the alcohol component is typically from 40 to 60 mol %, and preferably from 45 to 55 mol %. The content of the acid component is typically from 60 to 40 mol %, and preferably from 55 to 45 mol %.

Such polyester resins can generally be obtained by commonly known condensation polymerization.

The binder resin may include a vinyl resin.

Examples of polymerizable monomers (vinyl monomers) for producing the vinyl resin include the following:

styrene and styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-(n-butyl)styrene, p-tert-butylstyrene, p-(n-hexyl)styrene, p-(n-octyl)styrene, p-(n-nonyl)styrene, p-(n-decyl)styrene and p-(n-dodecyl)styrene; ethylenically unsaturated monoolefins such as ethylene, propylene, butylene and isobutylene; unsaturated polyenes such as butadiene and isobutylene; halogenated vinyls such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnapthalenes, and acrylic acid or methacrylic acid derivatives such as acrylonitrile, methacrylonitrile and acrylamide.

Additional examples include the following carboxyl group-containing monomers: unsaturated dibasic acids such as maleic acid, citraconic acid, itaconic acid, alkenylsuccinic acid, fumaric acid and mesaconic acid; unsaturated dibasic acid anhydrides such as maleic anhydride, citraconic anhydride, itaconic anhydride and alkenylsuccinic anhydride; half esters of unsaturated dibasic acids, such as the methyl half ester of maleic acid, the ethyl half ester of maleic acid, the butyl half ester of maleic acid, the methyl half ester of citraconic acid, the ethyl half ester of citraconic acid, the butyl half ester of citraconic acid, the methyl half ester of itaconic acid, the methyl half ester of alkenylsuccinic acid, the methyl half ester of fumaric acid and the methyl half ester of mesaconic acid; unsaturated dibasic acid esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride, as well as anhydrides of such α,β-unsaturated acids and lower fatty acids; and also alkenylmalonic acid, alkenylglutaric acid and alkenyladipic acid, as well as acid anhydrides and monoesters thereof.

Further examples include the following hydroxyl group-containing monomers: acrylic acid and methacrylic acid esters such as 2-hydroxyethyl acrylate, 2-hydroxyethyl methacrylate and 2-hydroxypropyl methacrylate; and also 4-(1-hydroxy-1-methylbutyl) styrene and 4-(1-hydroxy-1-methylhexyl)styrene.

In the toner of the invention, vinyl resins serving as the binder resin may have a crosslinked structure that has been crosslinked by a crosslinking agent having two or more vinyl groups. Illustrative examples of crosslinking agents that may be used in such a case include aromatic divinyl compounds such as divinylbenzene and divinylnaphthalene; diacrylate compounds joined by an alkyl chain, such as ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and any of the above compounds in which the acrylates have been replaced with methacrylates; diacrylate compounds joined by an ether bond-containing alkyl chain, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and any of the above compounds in which the acrylates have been replaced with methacrylates; diacrylate compounds joined by an aromatic group and ether bond-containing chain, such as polyoxyethylene (2)-2,2-bis(4-hydroxyphenyl)propane diacrylate, polyoxyethylene (4)-2,2-bis(4-hydroxyphenyl)propane diacrylate, and any of the above compounds in which the acrylates have been replaced with methacrylates; and polyester-type diacrylate compounds, such as that available under the trade name MANDA from Nippon Kayaku Co., Ltd.

Illustrative examples of multifunctional crosslinking agents include pentaerythritol triacrylate, trimethylolethane triacrylate, trimethylolpropane triacrylate, tetramethylolmethane tetraacrylate, oligoester acrylate, any of these compounds in which the acrylates have been replaced with methacrylates; and triallyl cyanurate and triallyl trimellitate.

These crosslinking agents may be used in an amount of generally from 0.01 to 10 mass parts, and preferably from 0.03 to 5 mass parts, per 100 mass parts of the monomer components other than the crosslinking agent.

Of these crosslinking monomers, from the standpoint of the fixing performance and the offset resistance, those preferred for use in the binder resin include aromatic divinyl compounds (particularly divinylbenzene), and diacrylate compounds joined by a chain having aromatic groups and ether bonds.

Illustrative examples of polymerization initiators that may be used in the production of vinyl resins as the binder resin include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetyl acetone peroxide and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl)benzene, isobutylperoxide, octanoyl peroxide, decanoyl peroxide, lauroyl peroxide, 3,5,5-trimethylhexanoyl peroxide, benzoyl peroxide, m-trioyl peroxide, di-isopropylperoxy dicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexyl sulfonyl peroxide, t-butyl peroxyacetate, t-butyl peroxyisobutyrate, t-butyl peroxyneodecanoate, t-butylperoxy-2-ethyl hexanoate, t-butyl peroxylaurate, t-butyl peroxybenzoate, t-butylperoxy isopropyl carbonate, di-t-butyl peroxyisophthalate, t-butyl peroxyallyl carbonate, t-amyl peroxy-2-ethylhexanoate, di-t-butyl peroxyhexahydroterephthalate and di-t-butyl peroxyazelate.

The binder resin according to this invention has a glass transition temperature (Tg) which, from the standpoint of readily achieving both low temperature fixability and storability, is generally not less than 45° C. and not more than 70° C., and preferably not less than 50° C. and not more than 70° C.

If Tg is below 45° C., the storability tends to worsen. On the other hand, if Tg is higher than 70° C., the low temperature fixability tends to worsen.

The toner particles of the invention include a colorant. Colorants that may be advantageously used in the invention include those mentioned below.

Examples of organic pigments and organic dyes suitable as cyan colorants include copper phthalocyanine compounds and derivatives thereof, anthraquinone compounds, and basic dye lake compounds.

Examples of organic pigments and organic dyes suitable as magenta colorants include condensed azo compounds, diketopyrrolopyrrole compounds, anthraquinone and quinacridone compounds, basic dye lake compounds, naphthol compounds, benzimidazolone compounds, thioindigo compound and perylene compounds.

Examples of organic pigments and organic dyes suitable as yellow colorants include condensed azo compounds, isoindolinone compounds, anthraquinone compounds, azo metal complexes, methine compounds and allylamide compounds.

Exemplary black colorants include carbon black or those obtained by color mixing to give a black color using the above yellow colorants, the above magenta colorants and the above cyan colorants.

In cases where a colorant is used, colorant addition in an amount of not less than 1 mass part and not more than 20 mass parts per 100 mass parts of the polymerizable monomer or binder resin is preferred.

The toner particles of the invention may also include a magnetic material. In the invention, the magnetic material may play the role of a colorant as well.

Illustrative examples of the magnetic material used in the invention include iron oxides such as magnetite, maghemite and ferrite; metals such as iron, cobalt or nickel, and alloys or mixtures of these metals with metals such as aluminum, cobalt, copper, lead, magnesium, tin, zinc, antimony, beryllium, bismuth, cadmium, calcium, manganese, selenium, titanium, tungsten and vanadium.

These magnetic materials have a number-based average particle diameter of not more than 2 μm, and preferably from 0.05 to 0.5 μm. The magnetic properties under the application of 795.8 kA/m were as follows: coercive force, 1.6 to 12.0 kA/m; saturation magnetization, 50 to 200 $Am^2/kg$ (preferably from 50 to 100 $Am^2/kg$); residual magnetization, 2 to 20 $Am^2/kg$.

The content of magnetic material in the inventive toner is generally not less than 35 mass % and not more than 50 mass %, and preferably not less than 40 mass % and not more than 50 mass %.

At less than 35 mass %, the magnetic attraction with the magnet rolls within the developing sleeve decreases, as a result of which fogging tends to worsen.

On the other hand, at more than 50 mass %, the developing performance decreases, as a result of which the density tends to decline.

Measurement of the content of the magnetic material within the toner can be carried out using a thermal analyzer (TGA-7) available from Perkin-Elmer. The method of measurement involves heating the toner from room temperature to 900° C. at a ramp rate of 25° C./min in a nitrogen atmosphere, measuring the loss of mass in the interval from 100 to 750° C. as the mass of the components left after excluding the magnetic material from the toner, and treating the remaining mass as the amount of magnetic material.

The magnetic material used in the inventive toner may be produced by, for example, the following method. An aqueous solution containing ferrous hydroxide is prepared by adding, to an aqueous ferrous salt solution, an equivalent or more with respect to the iron component of an alkali such as sodium hydroxide. Air is blown into the resulting aqueous solution while maintaining the pH of the solution at 7 or more, and an oxidation reaction is carried out on the ferrous hydroxide while warming the aqueous solution to not less than 70° C., thereby producing first the seed crystals which become the core of the magnetic iron oxide.

Next, an aqueous solution containing about one equivalent of ferrous sulfate, based on the previously added amount of alkali, is added to the seed crystal-containing slurry-like liquid. The ferrous hydroxide reaction is made to proceed while blowing in air and maintaining the pH of the liquid at from 5 to 10, thereby causing the magnetic ferrous oxide to grow about the seed crystals as the cores. By selecting the desired pH, reaction temperature and stirring conditions at this time, it is possible to control the shape and magnetic properties of the magnetic material. As the oxidation reaction proceeds, the pH of the liquid shifts to the acidic side, although it is preferable to keep the pH of the liquid from falling below 5. By filtering, washing and drying the resulting magnetic material in accordance with common practice, a magnetic powder can be obtained.

In the practice of the invention, when the toner is produced by a polymerization method, hydrophobic treatment of the surface of the magnetic material is highly desirable. In cases where a dry method is used for surface treatment, coupling agent treatment is carried out on the washed, filtered and dried magnetic material. In cases where a wet method is used for surface treatment, following completion of the oxidation reaction, the dried material is re-dispersed and coupling treatment is carried out. Alternatively, following completion of the oxidation reaction, the oxidized material obtained by washing and filtration is re-dispersed, without being dried, in another aqueous medium and coupling treatment is carried out. To be more precise, coupling treatment is carried out by thoroughly stirring the re-dispersion while at the same time adding a silane coupling agent and then raising the temperature following hydrolysis, or by adjusting the pH of the dispersion to the alkaline range following hydrolysis. Of these, from the standpoint of uniform surface treatment, following completion of the oxidation reaction, it is preferable to carry out surface treatment by, subsequent to filtration and washing, rendering the system as is into a slurry without any drying.

In a wet method of surface treating the magnetic material, i.e., to treat the magnetic material with a coupling agent in an aqueous medium, first the magnetic material is thoroughly dispersed as primary particles within an aqueous medium and is stirred with agitating blades or the like to keep it from settling and agglomerating. Next, the desired amount of coupling agent is poured into the dispersion and surface treatment is carried out while hydrolyzing the coupling agent. It is more preferable at this time to carry out surface treatment under stirring and while using an apparatus such as a pin mill, line mill or the like to effect thorough dispersion so that agglomeration does not occur.

Here, "aqueous medium" refers to a medium in which water is the chief component. Examples include water itself, water to which a small amount of a surfactant has been added, water to which a pH adjustor has been added, and water to which an organic solvent has been added. The surfactant is preferably a nonionic surfactant such as polyvinyl alcohol. The surfactant is preferably added in an amount of from 0.1 to 5.0 mass % with respect to the water. The pH adjustor is exemplified by inorganic acids such as hydrochloric acid. The organic solvent is exemplified by alcohols.

Exemplary coupling agents that can be used in surface treatment of the magnetic material in this invention include silane coupling agents and titanium coupling agents. The use of silane coupling agents of formula (I) below is even more preferred:

$$R_m SiY_n \quad \text{(I)}$$

(wherein R is an alkoxy group; m is an integer from 1 to 3; Y is a functional group such as an alkyl group, a vinyl group, an epoxy group or a (meth)acryl group; and n is an integer from 1 to 3, with the proviso that m+n=4).

Illustrative examples of silane coupling agents of formula (I) above include vinyl trimethoxysilane, vinyl triethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, from the standpoint of conferring high hydrophobic properties to the magnetic material, the use of an alkyltrialkoxysilane coupling agent of formula (II) below is preferred.

$$C_pH_{2p+1}—Si—(OC_qH_{2q+1})_3 \quad \text{(II)}$$

(wherein p is an integer from 2 to 20, and q is an integer from 1 to 3).

When p in above formula (II) is 2 or more, hydrophobic properties are more easily conferred to the magnetic material. When p is 20 or less, coalescence between particles of the magnetic material is more easily suppressed. Also, when q is 3 or less, the reactivity of the silane coupling agent readily improves, which is desirable. The use of an alkyltrialkoxysilane coupling agent for which p in formula (II) is an integer from 2 to 20 and q is an integer from 1 to 3 is preferred.

When the above silane coupling agent is used, treatment with one such silane coupling agent alone or a plurality of such silane coupling agents in combination is possible. When a plurality of silane coupling agents are used in combination, treatment may be carried out separately with each coupling agent or may be carried out at the same time with all of the coupling agents.

The overall amount of coupling agent used in treatment is preferably from 0.9 to 3.0 mass parts per 100 mass parts of the magnetic material. It is important to adjust the amount of treatment agent according to such factors as the surface area of the magnetic material and the reactivity of the coupling agent.

A charge control agent may be added to the toner of the invention. The charging performance of the inventive toner may be either positive or negative. However, because the binder resin itself has a high negative charging performance, it is preferable for the toner to be a negative-charging toner.

Exemplary charge control agents that are effective for negative charging include organic metal complexes and chelating compounds. Illustrative examples of these include monoazo metal complexes; acetylacetone metal complexes; and metal complexes and metal salts, as well as anhydrides, esters and phenol derivatives such as bisphenols of aromatic hydroxycarboxylic acids and aromatic dicarboxylic acids.

Preferred charge control agents for negative charging include Spilon Black TRH, T-77 and T-95 (Hodogaya Chemical Co., Ltd.), and Bontron® S-34, S-44, S-54, E-84, E-88 and E-89 (Orient Chemical Industries Co., Ltd.).

Illustrative examples of charge control agents for positive charging include nigrosin and modified products thereof obtained with, for example, fatty acid metal salts; quaternary ammonium salts such as tributylbenzylammonium 1-hydroxy-4-naphthsulfonate and tetrabutylammonium tetrafluoroborate, as well as onium salts such as phosphonium salts that are analogs thereof, and also lake pigments of these; triphenylmethane dyes and lake pigments thereof (with laking agents such as phosphotungstic acid, phosphomolybdic acid, phosphotungstomolybdic acid, tannic acid, lauric acid, gallic acid, ferricyanic acid and ferrocyan compounds); metal salts of higher fatty acids; diorganotin oxides such as dibutyltin oxides, dioctyltin oxide and dicyclohexyltin oxide; and organotin borates such as dibutyltin borate, dioctyltin borate and dicyclohexyltin borate. These may be used singly or two or more may be used in combination.

Preferred examples of charge control agents for positive charging include TP-302 and TP-415 (Hodogaya Chemical Co., Ltd.), Bontron® N-01, N-04, N-07 and P-51 (Orient Chemical Industries Co., Ltd.), and Copy Blue PR (Clariant).

These metal complex compounds may be used singly or two or more may be used in combination. From the standpoint of the toner charge quantity, the amount in which these charge control agents are used is preferably from 0.1 to 5.0 mass parts per 100 mass parts of the binder resin.

In the practice of this invention, from the standpoint of the ease of dispersion in the toner and the high release properties, preferred use can be made of hydrocarbon waxes such as low-molecular-weight polyethylene, low-molecular-weight polypropylene, microcrystalline wax and paraffin wax. If necessary, a small amount of one, two or more waxes may be used together. Examples include oxides of aliphatic hydrocarbon waxes such as oxidized polyethylene wax, and block copolymers thereof; waxes composed primarily of fatty acid esters, such as carnauba wax, sasol wax and montanic acid ester waxes; and fatty acid esters that are partially or completely deoxidized, such as deoxidized carnauba wax. Additional examples include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; long-chain alkyl alcohols; polyhydric alcohols such as sorbitol; fatty acid amides such as linoleamide, oleamide and lauramide; saturated fatty acid bisamides such as methylene bisstearamide, ethylene biscapramide, ethylene bislauramide and hexamethylene bisstearamide; unsaturated fatty acid amides such as ethylene bisoleamide, hexamethylene bisoleamide, N,N'-dioleyladipamide and N,N-dioleylsebacamide; aromatic bisamides such as m-xylenebisstearamide and N,N-distearylisophthalamide; fatty acid metal salts (those generally known as metal soaps) such as calcium stearate, calcium laurate, zinc stearate and magnesium stearate; waxes obtained by grafting a vinyl monomer such as styrene or acrylic acid onto an aliphatic hydrocarbon wax; fatty acids that have been partially esterified with a polyhydric alcohol, such as behenic acid monoglyceride; and hydroxyl group-containing methyl ester compounds obtained by, for example, the hydrogenation of plant-based oils.

The melting point of the wax, defined as the maximum endothermic peak during temperature rise in measurement with a differential scanning calorimeter (DSC), is preferably from 70 to 140° C., and more preferably from 90 to 135° C. When a melting point is less than 70° C., the toner viscosity tends to decrease and melt adhesion of the toner to the electrostatic latent image-bearing member tends to readily arise. On the other hand, when a melting point is higher than 140° C., the low temperature fixability tends to worsen.

As used herein, the "melting point" of a wax is determined by measurement in accordance with ASTM D3418-82 using a DSC (differential scanning calorimeter)-7 (by Perkin-Elmer). The measurement sample is precisely weighed in an amount of from 5 to 20 mg, and preferably 10 mg.

This sample is placed in an aluminum pan and, using an empty aluminum pan for reference, measurement at standard temperature and humidity is carried out at a ramp rate of 10° C./min within the measurement temperature range of 30 to 200° C. Because the maximum endothermic peak in the temperature range of 40 to 100° C. is obtained in a second temperature rise step, the temperature at that time is used as the wax melting point.

Although depending on the toner production method, the amount of wax is generally from 1 to 40 mass parts, and preferably from 2 to 30 mass parts, per 100 mass parts of the binder resin.

The silica fine particles used in this invention are most preferably fine particles produced by the vapor phase oxidation of a silicon halide, and are called dry silica or fumed silica. For example, in a production process which utilizes the pyrolytic oxidation reaction of silica tetrachloride gas in oxygen and hydrogen, the basic reaction scheme is as follows.

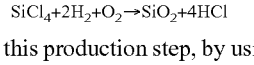

$$SiCl_4+2H_2+O_2 \rightarrow SiO_2+4HCl$$

In this production step, by using another metal halide such as aluminum chloride or titanium chloride together with the silicon halide, it is also possible to obtain composite fine particles of silica with another metal oxide. Such composite fine particles can be used in the invention.

The silica fine particles in this invention have a particle diameter such that the number-average particle diameter (D1) of the primary particles is not less than 5 nm and not more than 20 nm, preferably not less than 5 nm and not more than 15 nm, and more preferably not less than 7 nm and not more than 15 nm. By setting the particle diameter of the silica fine particles in the above range, during external addition and mixing treatment, the collision frequency between toner particles and silica fine particles readily becomes higher than that among silica fine particles, thus facilitating control of the coverage ratio X1, the diffusion index and the external additive embedding ratio.

The method used in the invention to measure the number-average particle diameter (D1) of the primary particles of the silica fine particles is described later in this specification.

It is preferable for the silica fine particles produced by the vapor phase oxidization of such a silicon halide to be treated silica fine particles in which the surface has been subjected to hydrophobic treatment. It is especially preferable for such treated silica fine particles to be ones obtained by treating silica fine particles so that the degree of hydrophobization, as measured by a methanol titration test, exhibits a value in the range of 30 to 80.

The method of hydrophobic treatment is exemplified by methods of chemical treatment with an organosilicon compound and/or a silicone oil that reacts with or physically adsorbs to the silica fine particles. An example of a preferred method is that of chemically treating, with an organosilicon compound, the silica fine particles produced by vapor phase oxidation of a silicon halide.

Illustrative examples of the organosilicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane and dimethylpolysiloxanes having from 2 to 12 siloxane units per molecule and having one hydroxyl group each on the silicons of the units positioned at the ends of the molecule. These may be used singly or as mixtures of two or more.

Silane coupling agents having a nitrogen group, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine may also be used alone or in combination. Preferred silane coupling agents include hexamethyldisilazane (HMDS).

The above silicone oils are preferably ones having a viscosity at 25° C. of from 0.5 to 10,000 $mm^2/S$, more preferably from 1 to 1,000 $mm^2/S$, and even more preferably from 10 to 200 $mm^2/S$. Specific examples include dimethyl silicone oil, methyl phenyl silicone oil, α-methylstyrene-modified silicone oil, chlorophenyl silicone oil and fluorine-modified silicone oil.

The silicone oil treatment method is exemplified by a method in which the silane coupling agent-treated silica fine particles and the silicone oil are directly mixed using a mixer such as a Henschel mixer; a method in which silicone oil is sprayed onto the silica fine particles serving as the base; and a method in which the silicone oil is dissolved or dispersed in a suitable solvent, after which the silica fine particles are added, mixing is carried out, and the solvent is removed.

Following silicone oil treatment, it is more preferable to stabilize the surface coat of the silicone oil-treated silica fine particles by heating the silica in an inert gas to not less than 200° C. (and preferably not less than 250° C.)

The silicone oil treatment amount is generally from 1 to 40 mass parts, and preferably from 3 to 35 mass parts, per 100 mass parts of the silica fine particles. In the above range, good hydrophobic properties are easily obtained.

In order to confer a good flowability to the toner, the silica fine particles used in this invention have a specific surface area, as measured by the BET method using nitrogen adsorption, of not less than 20 $m^2/g$ and not more than 350 $m^2/g$, and more preferably not less than 25 $m^2/g$ and not more than 300 $m^2/g$. It is preferable for silica fine particles in this range to be subjected to the above-described hydrophobic treatment.

The method of measuring the specific surface areas of silica fine particles and other external additives by the BET method using nitrogen adsorption shall be described later.

The silica fine particles used in this invention have a bulk density of preferably not less than 15 g/L and not more than 50 g/L, and more preferably not less than 20 g/L and not more than 40 g/L. By having the bulk density of the silica fine particles fall within this range, the silica fine particles are resistant to tight packing and exist with ample air between the particles, so that the bulk density is very low. As a result, the toner particles are resistant to tight packing, enabling the rate at which the toner deteriorates to be greatly lowered.

Examples of ways to control the bulk density of the silica fine particles within the above range include altering the particle diameter of base material silica used for the silica fine particles, regulating the strength of pulverizing treatment carried out before and after or during the above hydrophobic treatment, and adjusting, for example, the silicone oil treatment amount. By lowering the particle diameter of the base material silica, the BET specific surface area of the resulting silica fine particles becomes large and more air can be made present between the particles, enabling the bulk density to be reduced. Moreover, by carrying out pulverizing treatment, relatively large agglomerates included in the silica fine particles can be broken down into relatively small secondary particles, enabling the bulk density to be lowered.

Here, the amount of silica fine particles added per 100 mass parts of the toner particles is preferably not less than 0.3 mass part and not more than 2.0 mass parts, and more preferably not less than 0.3 mass part and not more than 1.5 mass parts.

By having the amount of silica fine particles added fall in the above range, suitable control of the coverage ratio, diffusion index, and the external additive embedding ratio is easy.

If more than 2.0 mass parts of the silica fine particles is added, the silica fine particles readily aggregate, as a result of which it tends to become difficult to achieve the desired diffusion index and the like.

A known mixing treatment apparatus may be used as the mixing treatment apparatus for externally adding and mixing the above silica fine particles. However, from the standpoint of being able to easily control the coverage ratio X1, the diffusion index and the external additive embedding ratio, an apparatus like that shown in FIG. 3 is preferred.

Figure 3:
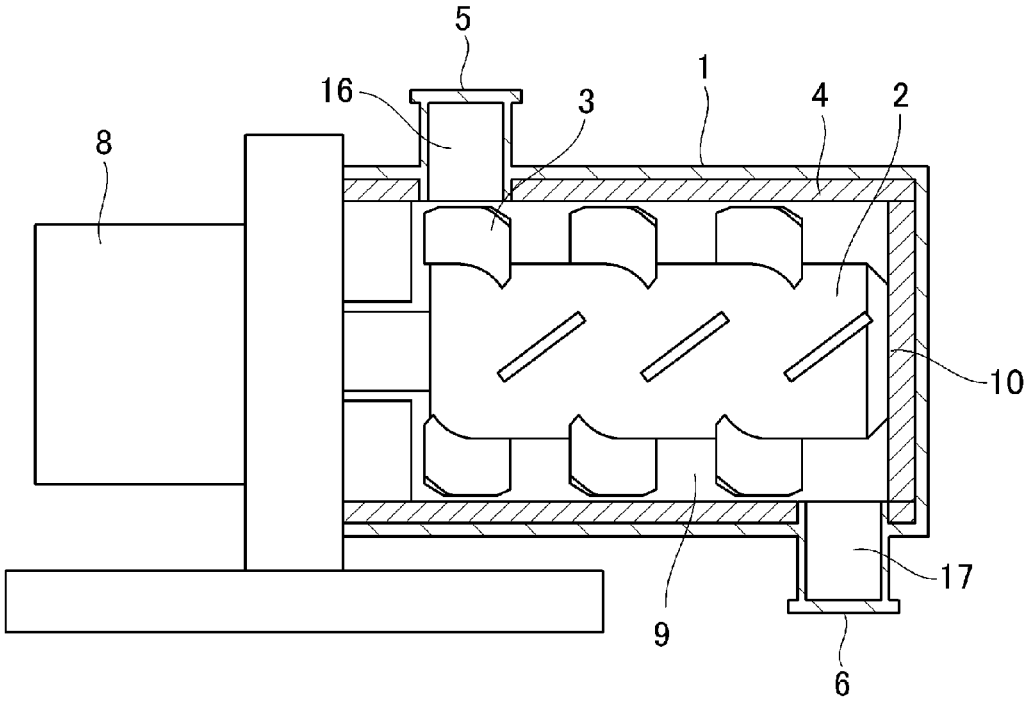
FIG. 3 is a schematic diagram showing an example of a mixing treatment apparatus which can be used for the external addition and mixing of inorganic fine particles.

FIG. 3 is a schematic diagram showing an example of a mixing treatment apparatus which can be used when externally adding and mixing the inorganic fine particles (silica fine particles and fine particles of a group 2 element salt of titanic acid) used in this invention.

Because this mixing treatment apparatus is constructed in such a way that shear acts upon the toner particles and the inorganic fine particles in an area of narrow clearance, the inorganic fine particles can be attached to the surfaces of the toner particles while being broken down from secondary particles into primary particles. By breaking down the inorganic fine particles into primary particles, the coverage ratio X1, the diffusion index and the external additive embedding ratio can be easily controlled within the preferred ranges.

In addition, as is subsequently explained, the toner particles and the inorganic fine particles readily circulate in the axial direction of the rotating member, allowing them to thoroughly and uniformly mix before sticking proceeds, and thus facilitating control of the coverage ratio X1, diffusion index and external additive embedding ratio within the preferred ranges of this invention.

A known mixing treatment apparatus (e.g., a Henschel mixer) may be used in this invention. From the standpoint of more readily controlling the external addition state in the invention, the apparatus shown in FIG. 3 is preferred.

That is, an apparatus like that in FIG. 3 has a construction which readily enables shear to act upon the toner, facilitating control of the coverage ratio X1, diffusion index and external additive embedding ratio with a short period of treatment.

Figure 4:
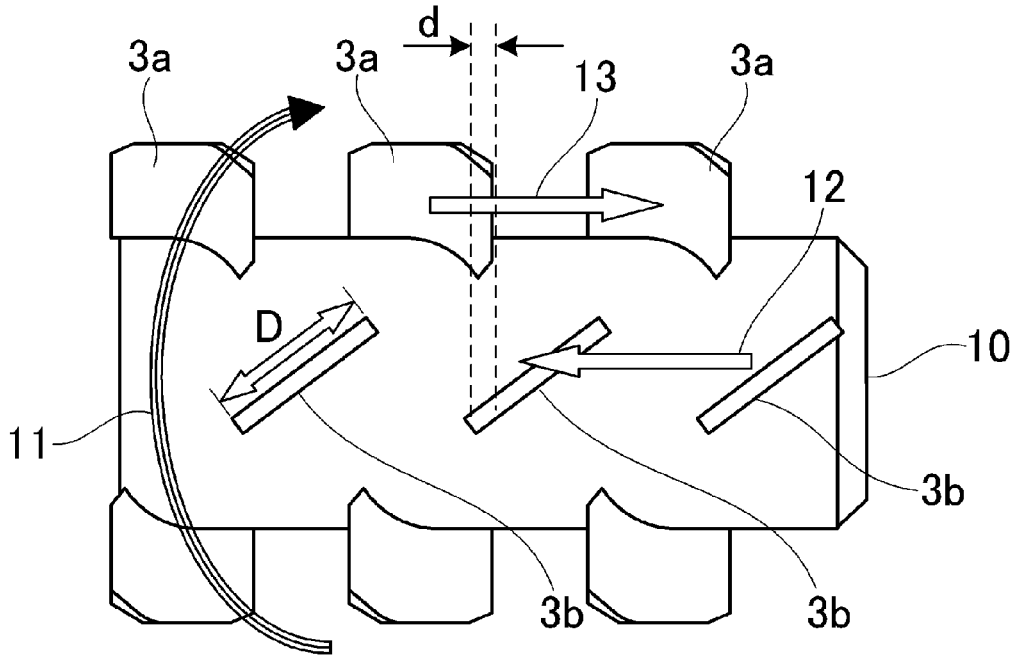
FIG. 4 is a schematic diagram showing an example of the construction of stirring members used in a mixing and treatment apparatus.

FIG. 4 is a schematic diagram showing an example of the construction of the stirring members used in the above mixing treatment apparatus. The external addition and mixing step for the above inorganic fine particles is described below in conjunction with FIGS. 3 and 4.

The mixing treatment apparatus which externally adds and mixes the above inorganic fine particles has a rotating member 2 with at least a plurality of stirring members 3 provided on the surface thereof, a drive unit 8 which rotationally drives the rotating member, and a body casing 1 which is provided in such a way that a gap exists between the body casing 1 and the stirring members 3.

The gap (clearance) between the inner peripheral portion of the body casing 1 and the stirring members 3 is preferably kept very small and constant so as to uniformly apply shear to the toner particles and enable the inorganic fine particles to easily adhere to the surface of the toner particles while being broken down from secondary particles into primary particles.

Also, in this apparatus, the diameter of the inner peripheral portion of the body casing 1 is no more than twice the diameter of the external peripheral portion of the rotating member 2. FIG. 3 shows a case in which the diameter of the inner peripheral portion of the body casing 1 is 1.7 times the diameter of the outer peripheral portion of the rotating member 2 (i.e., the diameter of the cylindrical body, excluding the stirring members 3 from the rotating member 2). By having the diameter of the inner peripheral portion of the body casing 1 be no more than twice the diameter of the outer peripheral portion of the rotating member 2, the treatment space where forces act upon the toner particles is suitably limited, allowing sufficient impact forces to be applied to the inorganic fine particles that are present as secondary particles.

It is preferable to adjust the clearance according to the size of the body casing. By setting the clearance to not less than about 1% and not more than about 5% the diameter of the inner peripheral portion of the body casing 1, sufficient shear can be applied to the inorganic fine particles. Specifically, when the diameter of the inner peripheral portion of the body casing 1 is about 130 mm, the clearance should be set to not less than about 2 mm and not more than about 5 mm. When the diameter of the inner peripheral portion of the body casing 1 is about 800 mm, the clearance should be set to not less than about 10 mm and not more than about 30 mm.

In use of the mixing treatment apparatus during the inorganic fine particle external addition and mixing step of the invention, the drive unit 8 rotates the rotating member 2, agitating and mixing toner particles and inorganic fine particles that have been charged into the mixing treatment apparatus, and thereby carrying out external addition and mixing treatment of the inorganic fine particles onto the surfaces of the toner particles.

As shown in FIG. 4, at least some of the plurality of stirring members 3 are shaped as forward transport stirring members 3*a* such that, with rotation of the rotating member 2, the toner particles and inorganic fine particles are transported in one axial direction of the rotating member. In addition, at least some of the plurality of stirring members 3 are shaped as backward transport stirring members 3*b* such that, with rotation of the rotating member 2, the toner particles and inorganic fine particles are transported in the other axial direction of the rotating member.

Here, as shown in FIG. 3, when a raw material charging port 5 and a product discharging port 6 are provided at both ends of the body casing 1, "forward direction" refers to the direction from the raw material charging port 5 toward the product discharging port 6 (rightward direction in FIG. 3).

That is, as shown in FIG. 4, the surfaces of the forward transport stirring members 3*a* are inclined so as to transport toner particles in the forward direction (13), and the surfaces of the backward transport stirring members 3*b* are inclined so as to transport toner particles and inorganic fine particles in the backward direction (12).

In this way, by repeatedly carrying out transport in the "forward direction" (13) and transport in the "backward direction" (12), external addition and mixing treatment of the inorganic fine particles onto the surface of the toner particles is carried out.

The stirring members 3*a* and 3*b* are formed as a set, each set being composed of a plurality of stirring members, which are arranged at intervals in the circumferential direction of the rotating member 2. In the example shown in FIG. 4, the stirring member 3*a* and 3*b* are formed as sets of two stirring members situated at mutual intervals of 180 degrees on the rotating member 2, although a larger number of stirring members may similarly form a set, such as three stirring members at intervals of 120 degrees or four stirring members at intervals of 90 degrees.

In the example shown in FIG. 4, the stirring members 3*a* and 3*b* are formed at equal intervals as a total of 12 stirring members.

In FIG. 4, D represents the width of a stirring member and d is an interval indicating an area of stirring member overlap. From the standpoint of efficiently transporting the toner particles and the inorganic fine particles in the forward and reverse directions, it is preferable for the width D to be not less than about 20% and not more than about 30% of the length of the rotating member 2 in FIG. 4. FIG. 4 shows an example in which this is 23%. In addition, the stirring member 3*a* and the stirring member 3*b* should mutually overlap; more specifically, when a line is extended vertically from one end of a forward transport stirring member 3*a*, it is preferable that there is some degree of vertical overlap d between the stirring member 3*a* and 3*b*. This makes it possible for shear to act efficiently upon the inorganic fine particles that are present as secondary particles. Having the radio D:d be not less than 10% and not more than 30% is preferable for applying shear.

In addition to the shape shown in FIG. 4, the stirring member shape may be, insofar as the toner particles can be transported in the forward direction and back direction and the clearance is retained, a shape having a curved surface or a paddle structure in which a distal blade element is connected to the rotating member 2 by a rod-shaped arm.

The invention is described in greater detail below in conjunction with the schematic diagrams of the apparatus shown in FIGS. 3 and 4.

The apparatus shown in FIG. 3 has a rotating member 2 having at least a plurality of stirring members 3 provided on the surface thereof, a drive unit 8 which rotationally drives the rotating member 2, and a body casing 1 provided so that a gap exists between the body casing 1 and the stirring members 3. In addition, the apparatus has, provided on the inside of the body casing 1 and on the sidewall 10 thereof at the end of the rotating member, a jacket 4 through which a cooling and heating medium is able to flow.

The apparatus shown in FIG. 3 also has both a raw material charging port 5 formed at the top of the body casing 1 for introducing the toner particles and the inorganic fine particles, and a product discharging port 6 formed at the bottom of the body casing 1 for discharging, from the body casing 1 to the exterior, toner which has been subjected to external addition and mixing treatment.

The apparatus shown in FIG. 3 additionally has a raw material charging port inner piece 16 inserted into the raw material charging port 5, and a product discharging port inner piece 17 inserted into the product discharging port 6.

In the invention, first, the raw material charging port inner piece 16 is removed from the raw material charging port 5, and toner particles are charged into a treatment space 9 from the raw material charging port 5. Next, inorganic fine particles are charged into the treatment space 9 from the raw material charging port 5, and the raw material charging port inner piece 16 is inserted. The rotating member 2 is then rotated (in the direction of rotation 11) by the drive unit 8, thereby subjecting the charged material to external addition and mixing treatment while being agitated and mixed by the plurality of stirring members 3 provided on the surface of the rotating member 2.

The charging sequence may begin with charging of the inorganic fine particles from the raw material charging port 5, and follow with charging of the toner particles from the raw material charging port 5. Alternatively, the toner particles and the inorganic fine particles may be mixed together beforehand with a mixing apparatus such as Henschel mixer, following which the resulting mixture may be charged from the raw material charging port 5 of the apparatus shown in FIG. 3.

In the practice of the invention, two-stage mixing may be carried out in which the toner particles and both the silica fine particles and the group 2 element titanate fine particles are all mixed together, following which more silica fine particles are added and mixed therewith. Two-stage mixing is advantageous from the standpoint of facilitating control of the coverage ratio X1, diffusion index, and eternal additive embedding ratio.

In terms of the specific external addition and mixing treatment conditions, controlling the power of the drive unit 8 to not less than 0.2 W/g and not more than 2.0 W/g is preferable for obtaining the coverage ratio X1, the diffusion index and the external additive embedding ratio stipulated in this invention. Controlling the power of the drive unit 8 to not less than 0.6 W/g and not more than 1.6 W/g is more preferred.

When the power is lower than 0.2 W/g, achieving a high coverage ratio X1 is difficult and the diffusion index has a tendency to be too low. On the other hand, when the power is higher than 2.0 W/g, the diffusion index becomes high and there is a tendency for too much external additive to be embedded on the toner particles.

The treatment time, although not particularly limited, is preferably not less than 3 minutes and not more than 10 minutes. At a treatment time shorter than 3 minutes, the coverage ratio X1 and the diffusion index have a tendency to become low.

The rotational speed of the stirring members during external addition and mixing is not particularly limited. However, in an apparatus where the volume of the treatment space 9 shown in FIG. 3 is $2.0\times10^{-3}$ $m^3$, when the stirring members 3 are of the shape shown in FIG. 4, it is preferable for the stirring members to have a rotational speed which is not less than 800 rpm and not more than 3,000 rpm. At a rotational speed of not less than 800 rpm and not more than 3,000 rpm, the coverage ratio X1, the diffusion index and the external additive embedding ratio stipulated in this invention can be easily achieved.

Also, in this invention, an especially preferred treatment method is to provide a premixing step before the external addition and mixing treatment operation. By adding a premixing step, the silica fine particles and the group 2 element titanate fine particles are uniformly dispersed to a high degree on the surface of the toner particles, making it easy to achieve a high coverage ratio X1 and also a high diffusion index.

More specifically, in terms of the premixing treatment conditions, setting the power of the drive unit 8 to not less than 0.06 W/g and not more than 0.20 W/g, and setting the treatment time to not less than 0.5 minute and not more than 1.5 minutes, is preferred. If the premixing treatment conditions are set to a load power which is lower than 0.06 W/g or a treatment time which is shorter than 0.5 minute, mixing that is sufficiently uniform for premixing is difficult to achieve. On the other hand, if the premixing treatment conditions are set to a load power which is higher than 0.20 W/g or a treatment time which is longer than 1.5 minutes, the silica fine particles may end up sticking to the surface of the toner particles before sufficiently uniform mixing has been carried out.

With regard to the rotational speed of the stirring members in premixing treatment, in an apparatus where the volume of the treatment space 9 shown in FIG. 3 is $2.0\times10^{-3}$ $m^3$, when the stirring members 3 are of the shape shown in FIG. 4, it is preferable for the stirring members to have a rotational speed which is not less than 50 rpm and not more than 500 rpm. Within this range, the coverage ratio X1 and the diffusion index stipulated in this invention are easily obtained.

Following the completion of external addition and mixing treatment, the inner piece 17 within the product discharging port 6 is removed, and toner is discharged from the product discharging port 6 by having the drive unit 8 rotate the rotating member 2. If necessary, coarse particles and the like are separated off from the resulting toner with a sieve such as a circular oscillating sieve, thereby giving the final toner.

The method of producing the toner particles of the invention is not particularly limited; a known method may be used. Production by pulverization is possible, although the toner particles obtained are generally of irregular shape. Accordingly, to obtain a physical property—an average circularity of not less than 0.960, carrying out mechanical, thermal or some kind of special treatment is preferably performed. It is thus advantageous to produce the toner particles of the invention by a dispersion polymerization method, an association aggregation method, a dissolution suspension method, a suspension polymerization method or the like within an aqueous medium. A suspension polymerization method is especially preferred because desirable physical properties are easily achieved. The toner particle of the invention can be obtained by dispersing a polymerizable monomer composition containing a polymerizable monomer and a colorant in an aqueous medium to effect granulation, and then polymerizing the polymerizable monomer contained within the granulated particles. The polymerization monomer used for this purpose may be one that was mentioned above as a binder resin material. From the standpoint of the balance between the developing performance and the fixing performance, the toner of the invention has a weight-average particle diameter (D4) which is typically not less than 5.0 μm and not more than 10.0 μm, and is preferably not less than 6.0 μm and not more than 9.0 μm.

In this invention, the average circularity of the toner particles is preferably not less than 0.960 and not more than 0.990, and more preferably not less than 0.970 and not more than 0.985. When the average circularity of the toner particles is not less than 0.960, the toner shape has a spherical or nearly spherical shape, enabling excellent flowability and a uniform triboelectric charging performance to be readily obtained. This is desirable because a high developing performance is easily maintained even in the late stages of a durability test. Moreover, toner particles having a high average circularity are preferred because, in external addition and mixing treatment of the above inorganic fine particles, the coverage ratio X1, the diffusion index and the external additive embedding ratio are more easily controlled within the ranges of the invention. From the standpoint also of the ease of toner disaggregation when pressure is applied thereto, a high average circularity is desirable in that an interlocking effect caused by the surface profile of the toner particles does not readily arise, enabling the ease of disaggregation to be further enhanced. When the toner particles have been produced in the above-mentioned aqueous medium, controlling the average circularity within the above range is easy. When pulverization has been used, control within the above range is possible by carrying out heat-sphering treatment or surface modification and fines removal.

In the case of production by a pulverization process, the binder resin and colorant, and also, if necessary, other additives such as a release agent are thoroughly mixed in a mixer such as a Henschel mixer or a ball mill. The mixture is then melt kneaded using a hot mixing apparatus such as a hot roll mill, kneader or extruder so as to disperse or dissolve the toner material. This is following by cooling and solidification, then pulverization, after which classification and, if necessary, surface treatment are carried out, yielding toner particles. With regard to the sequence of classification and surface treatment, these steps may be carried out in either order. In the classification step, for reasons having to do with the production efficiency, it is preferable to use a multi-grade classifier.

The above pulverization may be carried out by a method that uses a known pulverizing apparatus such as a mechanical impact mill or a jet mill. To obtain toner particles having the preferred average circularity in this invention, it is desirable to carry out pulverization under the application also of heat or to carry out treatment in which supplemental mechanical impact forces are applied. Alternatively, use can be made of a hot water bath process in which the finely pulverized (and, if necessary, classified) toner particles are dispersed in hot water, or a method in which the toner particles are passed through a hot stream of gas.

The means for applying mechanical impact forces is exemplified by a method which uses the Kryptron System from Kawasaki Heavy Industries, Ltd. or the Turbo Mill from Turbo Kogyo Co. Other examples includes methods which apply mechanical impact forces to the toner particles in the form of compressive forces, frictional forces or the like, as in the case of apparatuses such as the Mechanofusion system from Hosokawa Micron Corporation and the Nara Hybridization System from Nara Machinery Co., Ltd.

In a suspension polymerization process, first a polymerizable monomer composition is obtained by uniformly dissolving or dispersing the polymerizable monomer and the colorant, and also, where necessary, additives such as a polymerization initiator, a crosslinking agent and a charge control agent. Using a suitable agitator, the polymerizable monomer composition is dispersed in a continuous phase (e.g., an aqueous phase) containing a dispersion stabilizer and, at the same time, a polymerization reaction is carried out, thereby giving toner particles of the desired particle diameter. In the toner particles produced by this suspension polymerization process (also referred to subsequently as "polymerized toner particles"), the shapes of the individual toner particles are substantially all uniformly spherical. As a result, toner particles which satisfy the preferred condition in this invention of having an average circularity of not less than 0.960 are easily obtained. In addition, because these toner particles have a charge quantity distribution which is relatively uniform, they can be expected to provide an improved image quality.

The polymerizable monomer making up the polymerizable monomer composition is exemplified by the vinyl monomers mentioned above, although use of other known polymerizable monomers is also possible. Of these, from the standpoint of the developing characteristics and durability of the toner, the use of styrene or a styrene derivative, either by itself or in admixture with another polymerizable monomer, is preferred.

In the practice of the invention, the polymerizable initiator used in the above suspension polymerization process is preferably one having a half-life at the time of the polymerization reaction of not less than 0.5 hour and not more than 30.0 hours. The amount of polymerization initiator added is preferably not less than 0.5 mass part and not more than 20.0 mass parts per 100 mass parts of the polymerizable monomer.

Preferred examples of the polymerization initiator include those mentioned above and also azo or diazo-type polymerization initiators and peroxide-type polymerization initiators.

In the above suspension polymerization process, the above-mentioned crosslinking agent may be added during the polymerization reaction. The preferred amount of addition is not less than 0.1 mass part and not more than 10.0 mass parts per 100 mass parts of the polymerizable monomer.

As used herein, it is preferable for the crosslinking agent to be primarily a compound having two or more polymerizable double bonds. As mentioned above, examples include aromatic divinyl compounds, carboxylic acid esters having two double bonds, divinyl compounds, and compounds having three or more vinyl groups. These may be used singly, or as mixtures of two or more thereof.

The production of toner particles by suspension polymerization is described in detail below, although the invention is not limited in this regard. First, a polymerizable monomer composition, prepared by suitably adding together the above-described polymerizable monomer, colorant and the like, then uniformly dissolving or dispersing these ingredients with a disperser such as a homogenizer, a ball mill or an ultrasonic disperser, is suspended in an aqueous medium containing a dispersion stabilizer and granulated. When a disperser such as a high-speed agitator or an ultrasonic disperser is used at this time to achieve the desired toner particle size in a single step, the resulting toner particles have a sharp particle diameter. With regard to the timing of polymerization initiator addition, such addition may be carried out simultaneous with the addition of other additives to the polymerizable monomer, or mixture may be carried out just prior to suspension in the aqueous medium. Alternatively, it is also possible to add polymerization initiator that was dissolved in the polymerizable monomer or a solvent immediately after granulation and prior to the start of the polymerization reaction.

Following granulation, agitation to a degree, at which the particle state is maintained and the floating and settling of particles are prevented, may be carried out using an ordinary agitator.

A known surfactant, organic dispersant or inorganic dispersant may be used as the dispersion stabilizer. Of these, the use of an inorganic dispersant is preferred because such dispersants do not readily give rise to harmful ultrafine powder, their steric hindrance provides dispersion stability, as a result of which the stability does not readily break down even when the reaction temperature is changed, and cleaning is easy and tends not to have an adverse impact on the toner particles. Illustrative examples of such inorganic dispersants include polyvalent metal salts of phosphoric acid, such as tricalcium phosphate, magnesium phosphate, aluminum phosphate, zinc phosphate and hydroxyapatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

These inorganic dispersants may be used in an amount of not less than 0.20 mass part and not more than 20.00 mass parts per 100 mass parts of the polymerizable monomer. The above dispersion stabilizer may be used singly or a plurality of dispersion stabilizers may be used in combination. In addition, concomitant use may be made of not less than 0.0001 mass part and not more than 0.1000 mass part of a surfactant per 100 mass parts of the polymerizable monomer.

In the polymerization reaction on the above polymerizable monomer, the polymerization temperature is set to not less than 40° C., and generally to not less than 50° C. and not more than 90° C.

After polymerization of the polymerizable monomer is complete, toner particles are obtained by filtration, washing and drying of the resulting polymer particles by known methods. The silica fine particles and the group 2 element titanate fine particles serving as the inorganic fine particles are externally added and mixed with these toner particles, and thereby deposited on the surfaces of the toner particles, yielding the toner of the invention.

It is also possible to include a classifying step in the production process (prior to mixing of the inorganic fine particles), and thereby remove coarse powder and fine powder included in the toner particles.

Next, an example of an image-forming apparatus capable of advantageously using the toner of the invention is described in detail while referring to FIG. 1. FIG. 1 shows an electrostatic latent image bearing member (also referred to below as a "photosensitive member") 100 and, provided at the periphery thereof, a charging member (charging roller) 117, a developing device 140 having a toner bearing member 102, a transfer member (transfer charging roller) 114, a waste toner receptacle 116, a fixing unit 126 and a pickup roller 124. The electrostatic latent image bearing member 100 is electrostatically charged by the charging roller 117. Next, exposure is carried out by using a laser generator 121 to shine laser light onto the electrostatic latent image bearing member 100, resulting in the formation of an electrostatic latent image corresponding to the target image. The electrostatic latent image on the electrostatic latent image bearing member 100 is developed with a single-component toner by the developing device 140, giving a toner image. The toner image is then transferred onto a transfer material by the transfer roller 114 which has been contacted with the electrostatic latent image bearing member through the transfer material. The transfer material on which the toner image has been placed is transported to the fixing unit 126, where the toner image is fixed onto the transfer material. The portion of the toner that remains on the electrostatic latent image bearing member is scraped off with a cleaning blade and held in the waste toner receptacle 116.

Next, the methods of measuring the various properties relating to this invention are described.

<Method of Quantifying Silica Fine Particles>

(1) Determination of Silica Fine Particle Content in Toner (Standard Addition Method)

Toner (3 g) is added to a 30-mm diameter aluminum ring, and a pellet is produced under an applied pressure of 10 metric tons. The intensity of silicon (Si) is measured (Si Intensity-1) by wavelength-dispersive fluorescent x-ray analysis (XRF). It suffices for the measurement conditions to be conditions that have been optimized in the XRF unit used, although a series of intensity measurements are all be carried out under the same conditions. Silica fine particles composed of primary particles having a number-average particle diameter of 12 nm are added in an amount of 1.0 mass % with respect to the toner, and mixing is carried out using a coffee mill.

Following mixture, pelletization is carried out in the same way as described above, after which the intensity of Si is determined as described above (Si Intensity-2). In addition, the Si intensities for samples obtained by carrying out similar operations to add and mix, with respect to the toner, 2.0 mass % or 3.0 mass % of silica fine particles are also determined (Si Intensity-3, Si Intensity-4). Using the Si Intensity-1 to Si Intensity-4 values, the silica content (mass %) in the toner is calculated by the standard addition method.

(2) Separation of Silica Fine Particles from Toner

In cases where the toner contains a magnetic material, determination of the silica fine particles is carried out by the following step.

Using a precision scale, 5 g of toner is weighed out into a 200-mL plastic cup with cap, following which 100 mL of methanol is added and dispersion is effected for 5 minutes in an ultrasonic disperser. After attracting the toner with a neodymium magnet, the supernatant is discarded. The operations of dispersal in methanol and discarding supernatant are repeated three times. Then, 100 mL of 10% NaOH and several drops of Contaminon N (a 10-mass % aqueous solution of a neutral (pH 7) cleanser for cleaning precision analyzers which is composed of a nonionic surfactant, an anionic surfactant and an organic builder; available from Wako Pure Chemical Industries, Ltd.) are added and lightly mixed, following which the mixture is left at rest for 24 hours. Next, separation is again carried out using a neodymium magnet. Distilled water is repeatedly poured in at this time so that NaOH does not remain behind. The recovered particles are thoroughly dried with a vacuum drier, giving Particle A. The added silica fine particles are dissolved and removed by the foregoing operations.

(3) Measurement of Si Intensity in Particle A

Three grams of Particle A is placed in a 30-mm diameter aluminum ring and a pellet is formed under a pressure of 10 metric tons. The Si intensity (Si Intensity-5) is determined by wavelength-dispersive x-ray analysis (XRF) on the pellet. The silica content (mass %) within Particle A is calculated using Si Intensity-5 and also the Si Intensity-1 to Si Intensity-4 values used to determine the silica content in the toner.

(4) Separation of Magnetic Material from Toner

After adding 100 mL of tetrahydrofuran to 5 g of Particle A and thoroughly mixing, ultrasonic dispersion is carried out for 10 minutes. The magnetic particles are attracted with a magnet and the supernatant is discarded. These operations are repeated 5 times, yielding Particle B. In this way, aside from the magnetic material, substantially all resin and other organic components can be removed. However, because there is a possibility of tetrahydrofuran-insoluble components within the resin remaining behind, it is preferable to heat the Particle B obtained from the above operations to 800° C. so as to burn off any remaining organic components. The Particle C obtained after such heating can closely approximate the magnetic material that was included in the toner.

By measuring the mass of Particle C, the magnetic material content W (mass %) within the toner can be obtained. At this time, to correct for the increase in mass due to oxidation of the magnetic material, the mass of Particle C is multiplied by 0.9666 ($Fe_2O_3 \rightarrow Fe_3O_4$). The amount of externally added silica fine particles is calculated by substituting the respective assay values in the following formula.

Amount of externally added silica fine particles (mass %)=silica content (mass %) in toner−silica content (mass %) in Particle *A*

<Method of Quantifying Group 2 Element Titanate Fine Particles>

Quantitative determination of the group 2 element titanate fine particles can be carried out by the standard addition method in the same way as the above-described method for quantitatively determining the silica fine particles.

For example, when strontium titanium fine particles is used as the group 2 element titanate fine particles, quantitative determination is possible by using the Sr intensity obtained by wavelength-dispersive fluorescent x-ray analysis (XRF) using strontium titanate fine particles having a number-average particle diameter of 120 nm.

If fine particles of another group 2 element titanate are included in the toner, by using the same type of standard addition method for group 2 element titanate fine particles in the same way as described above and suitably selecting the target element in XRF, quantitative determination is possible.

<Method of Measuring Coverage Ratio X1>

The coverage ratio X1 by silica fine particles on the surfaces of the toner particles is calculated as follows.

Elemental analysis of the surface of the toner particles is carried out using the following measurement apparatus under the conditions indicated. Measurement apparatus: Quantum 2000 (trade name, from Ulvac-Phi, Inc.)

X-ray source: Monochrome Al Kα

X-ray setting: 100 μm diameter (25 W (15 KV))

Photoelectron take-off angle: 45°

Neutralization conditions: joint use of neutralization gun and ion gun

Analysis region: 300×200 μm

Pass energy: 58.70 eV

Step size: 1.25 eV

Analytic software: Multipak (PHI)

Here, the C 1c (B.E. 280 to 295 eV), O 1s (B.E. 525 to 540 eV) and Si 2p (B.E. 95 to 113 eV) peaks were used to calculate the assay value for elemental Si. The elemental Si assay value obtained here is labeled "Y1".

Next, as in the above-described elemental analysis of the surfaces of toner particles, elemental analysis of the silica fine particles alone is carried out, and the assay value for elemental Si obtained here is labeled "Y2".

In the present invention, the coverage ratio X1 by silica fine particles on the surfaces of the toner particles is defined by the following formula using the above values Y1 and Y2.

Coverage ratio $X1$(surface area %)=$Y1/Y2 \times 100$

To improve the accuracy of this measurement, it is preferable to carry out the measurement of Y1 and Y2 two or more times.

When determining the assay value Y2, measurement is best carried out using the silica fine particles that were used in external addition, if they are available for such use.

In cases where silica fine particles that have separated from the surfaces of toner particles are used as the measurement sample, separation of the silica fine particles from the toner particles is carried out by the following procedure.

1) In the Case of a Magnetic Toner

First, a dispersion medium is created by adding 6 mL of Contaminon N (a 10-mass % aqueous solution of a neutral (pH 7) cleanser for cleaning precision analyzers which is composed of a nonionic surfactant, an anionic surfactant and an organic builder; available from Wako Pure Chemical Industries, Ltd.) to 100 mL of ion-exchanged water. Five grams of toner is then added to this dispersion medium and dispersion is carried out for 5 minutes in an ultrasonic disperser. Next, this dispersion is set in a KM Shaker (model V. SX, from Iwaki Industry Co., Ltd.) and reciprocally shaken for 20 minutes at 350 rpm. The supernatant is then gathered using a neodymium magnet to hold back the toner particles. This supernatant is dried, thereby collecting the silica fine particles. In cases where a sufficient amount of silica fine particles cannot thus be collected, these operations are repeatedly carried out.

When an external additive other than silica fine particles has been added, the external additive other than silica fine particles can also be collected by this method. In such a case, it is best to separate off the silica fine particles by centrifugal separation or the like from the external additive that has been collected.

2) In the Case of a Non-Magnetic Toner

A sucrose syrup is prepared by adding 160 g of sucrose (Kishida Kagaku) to 100 mL of ion-exchanged water and dissolving the sugar on a hot water bath. A dispersion is prepared by placing 31 g of the sucrose syrup and 6 mL of Contaminon N in a centrifuge tube. One gram of toner is added to this dispersion, and clumps of toner are broken up with a spatula or the like.

The centrifuge tube is reciprocally shaken for 20 minutes at 350 rpm on the above-mentioned shaker. After shaking, the solution is transferred to a 50-mL glass tube for a Swing Rotor centrifuge and centrifuged at 3,500 rpm for 30 minutes on the centrifuge. In the glass tube following centrifugation, toner is present in the uppermost layer and silica fine particles are present on the aqueous solution side serving as the bottom layer. The aqueous solution serving as the bottom layer is gathered and subjected to centrifugation, thereby separating the sucrose and the silica fine particles, and the silica fine particles are collected. After repeatedly carrying out centrifugation and thoroughly carrying out separation as needed, the dispersion is dried and the silica fine particles are collected.

As in the case of magnetic toner, if an external additive other than silica fine particles has been added, the external additive other than silica fine particles is collected. The silica fine particles are thus separated off by centrifugal separation or the like from the external additive that has been collected.

<Method of Measuring Weight-Average Particle Diameter (D4) of Toner>

The weight-average particle diameter (D4) of the toner is calculated as follows (calculation is carried out in the same way in the case of toner particles as well). The measurement apparatus is a precision analyzer for particle characterization based on the pore electrical resistance method and equipped with a 100-μm aperture tube (Coulter Counter Multisizer 3®, manufactured by Beckman Coulter). Dedicated software (Beckman Coulter Multisizer 3, Version 3.51 (from Beckman Coulter)) furnished with the device is used for setting the measurement conditions and analyzing the measurement data. Measurement is carried out with the following number of effective measurement channels: 25,000.

The aqueous electrolyte solution used in measurement is one that has been obtained by dissolving sodium chloride (guaranteed reagent grade) in ion-exchanged water to a concentration of about 1 mass %. For example, use can be made of ISOTON II (from Beckman Coulter).

Prior to carrying out measurement and analysis, the following settings are carried out on the dedicated software.

From the "Changing Standard Operating Mode (SOM)" screen of the dedicated software, select the Control Mode tab and set the Total Count to 50,000 particles, the Number of Runs to 1, and the Kd value to the value obtained using "Standard particle 10.0 μm" (Beckman Coulter). Pressing the "Threshold/Noise Level Measuring Button" automatically sets the threshold and noise levels. Set the Current to 1,600 μA, the Gain to 2 and the Electrolyte to ISOTON II, and place a check mark by "Flush aperture tube following measurement".

In the "Convert Pulse to Size Settings" screen of the dedicated software, set the Bin Spacing to "Log Diameter", the number of Size Bins to "256", and the particle size range to "from 2 μm to 60 μm".

The specific measurement method is as follows.

(1) Place about 200 mL of the above aqueous electrolyte solution in a 250-mL glass round-bottomed beaker for the Multisizer 3, set the beaker on the sample stand, and carry out stirring counterclockwise with a stirrer rod at a speed of 24 rotations per second. Then use the "Aperture Flush" function in the dedicated software to remove debris and air bubbles from the aperture tube.

(2) Place about 30 mL of the aqueous electrolyte solution in a 100-mL glass flat-bottomed beaker. Add thereto about 0.3 mL of a dilution obtained by diluting the dispersant "Contaminon N" (a 10-mass % aqueous solution of a neutral (pH 7) cleanser for cleaning precision analyzers which is composed of a nonionic surfactant, an anionic surfactant and an organic builder; available from Wako Pure Chemical Industries, Ltd.) about 3-fold by weight with ion-exchanged water.

(3) Prepare for use a Tetora 150 ultrasonic dispersion system (Nikkaki Bios) having an electrical output of 120 W and equipped with two oscillators which oscillate at 50 kHz and are configured at a phase offset of 180 degrees. Place about 3.3 L of ion-exchanged water in the water tank of the system, and add about 2 mL of Contaminon N to the tank.

(4) Set the beaker prepared in (2) above in a beaker-securing hole of the ultrasonic dispersion system, and operate the system. Adjust the beaker height position so as to maximize the resonance state of the aqueous electrolyte solution liquid level within the beaker.

(5) Add about 10 mg of toner a little at a time to the aqueous electrolyte solution within the beaker in (4) above while subjecting the solution to ultrasonic irradiation so as to effect dispersion. Then continue ultrasonic dispersion treatment for 60 seconds while suitably regulating operation so that the water temperature in the tank is not less than 10° C. and not more than 40° C.

(6) Using a pipette, carry out the dropwise addition of the aqueous electrolyte solution in (5) above having toner dispersed therein to the round-bottomed beaker in (1) above that has been set on the sample stand, and adjust the measurement concentration to about 5%. Next, continue measurement until the number of measured particles reaches 50,000.

(7) Carry out analysis of the measurement data using the dedicated software provided with the Multisizer 3 system, and compute the weight-average particle diameter (D4). When "Graph/Vol %" is selected in the dedicated software program, the "average size" in the "Analysis/Volume Statistics (Cumulative Average)" image plane is the weight-average particle diameter (D4).

<Method of Measuring Number-Average Particle Diameters (D1) of Primary Particles of Silica Fine Particles and Fine Particles of Group 2 Salt of Titanic Acid>

The number-average particle diameters of primary particles of the silica fine particles and the group 2 element titanate fine particles are calculated from images of silica fine particles and group 2 element titanate fine particles on toner particle surfaces taken with a Hitachi S-4800 ultrahigh resolution field-emission scanning electron microscope (Hitachi High-Technologies Corporation). The S-4800 image-capturing conditions are as follows.

(1) Sample Preparation

Conductive paste is spread lightly over the microscope stage (an aluminum stage measuring 15 mm×6 mm), and toner is blown thereon. Air is then blown over the toner, removing excess toner from the stage and thoroughly drying the paste. Next, the stage is set in a sample holder and the stage height is adjusted to 36 mm with a sample height gauge.

(2) Setting the S-4800 Observation Conditions

The number-average particle diameters of primary particles of the silica fine particles and the group 2 element titanate fine particles are calculated using images obtained by backscattered electron image observation with the S-4800. Compared with a secondary electron image, in a backscattered electron image, less charge-up of the particles occurs, as a result of which the particle diameters can be precisely measured.

Pour liquid nitrogen to the point of overflowing into an anti-contamination trap mounted on the S-4800 housing, and let the microscope stand for 30 minutes. Next, boot up the PC-STEM software for the S-4800, and carry out flushing (cleaning of the FE chip serving as the electron source). Then click on the acceleration voltage indicator portion of the control panel on the screen, press the "Flushing" button, and open the Flushing Execution dialog box. After checking that the flushing strength is 2, execute flushing. Verify that the emission current due to flushing is from 20 to 40 μA. Insert the sample holder in the sample chamber on the S-4800 housing. Press "Origin" on the control panel, and move the sample holder to the examination position.

Click the acceleration voltage indicator and open the HV selection dialog box, then set the acceleration voltage to "0.8 kV" and the emission current to "20 μA". Within the "Basic" tab on the operation panel, set the signal selection to "SE", select "Up (U)" and "+BSE" as the SE detectors and, in the selection box to the right of "+BSE", select "L.A. 100", thereby setting the microscope in the mode for examination in a backscattered electron image. Also within the "Basic" tab in the operation panel, set the probe current in the Electron Optics Conditions block to "Normal", the focus mode to "UHR", and WD to "3.0 mm". Apply the acceleration voltage by pressing the "ON" button of the acceleration voltage indicator on the control panel.

(3) Calculation of Number-Average Particle Diameter (D1) of Primary Particles of Silica Fine Particles and Group 2 Element Titanate Fine Particles Drag the magnification indicator on the control panel and set the magnification to 100,000× (100 k). Rotate the "Coarse" focus knob on the operation panel and, once the image is more or less in focus, carry out adjustment of the aperture alignment. Click on "Align" in the control panel to display the alignment dialog box, and select "Beam". Rotate the "Stigma/Alignment" knobs (X, Y) on the operation panel so as to move the displayed beam to the center of the concentric circles. Next, select "Aperture" and, turning the "Stigma/Alignment" knobs (X, Y) one at a time, adjust them so as to stop or minimize image movement. Close the aperture dialog box and use Autofocus to adjust the focus. Repeat this operation two more times to adjust the focus.

Next, measure the particle diameters for not less than 300 fine particles of silica and 300 fine particles of the group 2 element titanate on the toner particle surfaces, and determine the average particle diameters. Here, because some of the silica fine particles and the group 2 element titanate fine particles are present as agglomerates, the number-average particle diameters (D1) of primary particles of the silica fine particles and the group 2 element titanate fine particles are obtained by determining the maximum diameters of particles that can be confirmed to be primary particles and calculating the arithmetic mean of the maximum diameters thus obtained.

<Method of Measuring Average Circularity of Toner Particles>

The average circularity of the toner particles is measured with an FPIA-3000 (Sysmex Corporation) flow particle image analyzer under the measurement and analysis conditions at the time of calibration work.

The method of measurement is as follows. First, about 20 mL of ion-exchanged water from which solid impurities have been removed beforehand is placed in a glass vessel. Next, about 0.2 mL of a dilution prepared by diluting Contaminon N (a 10-mass % aqueous solution of a neutral (pH 7) cleanser for cleaning precision analyzers which is composed of a nonionic surfactant, an anionic surfactant and an organic builder; available from Wako Pure Chemical Industries, Ltd.) with an approximately three-fold mass of ion-exchanged water is added to the dispersion. About 0.02 g of the measurement sample is then added and dispersion treatment is carried out for 2 minutes using an ultrasonic disperser, thereby forming a dispersion for measurement. The dispersion is suitably cooled at this time to a temperature of not less than 10° C. and not more than 40° C. Using a desktop ultrasonic cleaner/disperser (e.g., VS-150 from Velvo-Clear) having an oscillation frequency of 50 kHz and an electrical output of 150 W as the ultrasonic disperser, a given amount of ion-exchanged water is placed in the water tank and about 2 mL of Contaminon N is added to the tank.

Measurement is carried out using the above-mentioned flow particle image analyzer equipped with, as the object lens, a "UPlanApro" (enlargement, 10×; numerical aperture, 0.40), and using the particle sheath "PSE-900A" (Sysmex Corporation) as a sheath reagent. The dispersion prepared according to the procedure described above is introduced to the flow particle image analyzer and, in the HPF measurement mode, 3,000 toner particles are measured in the total count mode. Next, setting the binarization threshold during particle analysis to 85% and restricting the analyzed particle diameter to a circle-equivalent diameter of not less than 1.985 μm and less than 39.69 μm, the average circularity of the toner particles is determined.

In implementing measurement, prior to the start of measurement, automatic focal point adjustment is carried out using standard latex particles (e.g., a dilution with ion-exchanged water of "Research and Test Particles: Latex Microsphere Suspensions 5200A", from Duke Scientific). Thereafter, it is preferable to carry out focal point adjustment every 2 hours following the start of measurement.

In this invention, use is made of a flow particle image analyzer for which the calibration work by Sysmex was carried out and for which a calibration certification issued by Sysmex Corporation was received. Aside from limiting the analyzed particle diameters to a circle-equivalent diameter of not less than 1.985 μm and less than 39.69 μm, measurement is carried out under the measurement and analysis conditions at the time that the calibration certificate was received.

The measurement principle employed in the FPIA-3000 (Sysmex Corporation) flow particle image analyzer is to capture the flowing particles as still images and carry out image analysis. The sample that has been added to the sample chamber is fed to a flat sheath flow cell with a sample suctioning syringe. The sample fed into the flat sheath flow cell is sandwiched between the sheath reagent, forming a flattened flow. The sample passing through the flat sheath flow cell is irradiated at 1/60-second intervals with a strobe light, enabling the flowing particles to be captured as still images. Because the flow is flattened, the images are captured in a focused state. The particle images are captured with a CCD camera, and the captured images are image processed at a 512×512-pixel image processing resolution (0.37 μm×0.37 μm per pixel), following which contour extraction is carried out on each particle image, and the projected area S, perimeter length L and the like for the particle image are calculated.

Next, the circle-equivalent diameter and circularity are determined using the above surface area S and perimeter length L. Here, "circle-equivalent diameter" refers to the diameter of a circle having the same surface area as the projected surface area of the particle image. "Circularity" is defined as the value obtained by dividing the circumference of the circle calculated from the circle-equivalent diameter by the circumference of the projected image of the particle, and is computed as follows.

$$\text{Circularity}=2\times(\pi\times S)^{1/2}/L$$

When the particle image is circular, the circularity is 1.000. As the degree of unevenness in the circumference of the particle image becomes larger, the circularity value becomes smaller. After the circularities of the respective particles have been calculated, the circularity range of 0.200 to 1.000 is divided into 800 values and the arithmetic mean of the resulting circularities is calculated. The value thus obtained is treated as the average circularity.

<Method of Measuring Bulk Density of Silica Fine Particles>

The bulk density of the silica fine particles is measured by slowly adding a measurement sample that has been placed on a piece of paper to a 100-mL measuring cylinder until the cylinder contains 100 mL of the sample, determining the difference in the mass of the measuring cylinder before and after adding the sample, and using the formula below to calculate the bulk density. When adding the sample to the measuring cylinder, care is taken to avoid tapping or otherwise disturbing the paper.

Bulk density (g/L)=(mass (g) when 100 mL has been charged)/0.1

<Method of Measuring True Specific Gravities of Toner and Silica Fine Particles>

The true specific gravities of the toner and the silica fine particles were measured with a dry automated densitometer-autopycnometer (Yuasa Ionics). The measurement conditions were as follows.

Cell: SM cell (10 mL)

Sample mass: about 2.0 g (toner), 0.05 g (silica fine particles)

This measurement method measures the true specific gravity of solids and liquids based on the vapor-phase substitution method. As with the liquid-phase substitution method, this is based on the Archimedean principle. However, because gas (argon gas) is used as the substitution medium, the precision for very small pores is high.

<Method of Measuring Free Ratio of Group 2 Element Titanate Fine Particles>

Sample Preparation

Toner Before Freeing: Each type of toner produced in the subsequently described working examples is used directly as is.

Toner After Freeing: 20 g of 2-mass % aqueous solution of Contaminon N (a neutral (pH 7) cleanser for cleaning precision analyzers which is composed of a nonionic surfactant, an anionic surfactant and an organic builder) is weighed out into a 50-mL vial and mixed with 1 g of toner. This mixture is set in a KM Shaker (model V. SX, from Iwaki Industry Co., Ltd.) and shaking is carried out for 30 seconds at a speed setting of 50. Next, the toner and the aqueous solution are separated in a centrifuge (5 minutes at 1,000 rpm), the supernatant is separated off, and the toner that has precipitated is vacuum-dried to hardness, giving the sample.

External Additive-Free Toner: As used herein, "external additive-free toner" refers to the toner state after external additive capable of being freed from toner particles has been removed in this test. The method of sample preparation involves placing toner in a solvent such as isopropanol which does not dissolve the toner, and subjecting this to 10 minutes of oscillation in an ultrasonic cleaner. Next, the toner and the solvent are separated in a centrifuge (5 minutes at 1,000 rpm). The supernatant is separated off, and the toner that has precipitated is vacuum-dried to hardness, giving the sample.

For these samples before and after the removal of free external additive, the free amount was determined by carrying out quantitative determination of the group 2 element titanate fine particles using the intensity of the target element (this being strontium when strontium titanate fine particles are used as the group element titanate fine particles) obtained by wavelength-dispersive fluorescent x-ray analysis (XRF).

(i) Examples of Apparatuses Used

3080 X-ray Fluorescence Spectrometer (Rigaku Denki)
Sample Press (Maekawa Testing Machine Mfg. Co., Ltd.)

(ii) Measurement Conditions

Measurement potential and voltage: 50 kV, 50 to 70 mA 2θ angle: a
Crystal plate: LiF
Measurement time: 60 seconds (iii) Method of Calculating Free Ratio from Toner First, the element intensities for the toner before freeing, the toner after freeing and the external additive-free toner are determined by the above method. Then, the free ratio is calculated based on the formula shown below.

For the sake of illustration, the formula is shown for a case in which strontium titanate fine particles are used as the group 2 element titanate fine particles and strontium is the target element. (By selecting a suitable target element according to the type of group 2 element titanate fine particles, calculation by a similar method is possible.)

Free Ratio of Strontium Titanate Free Particles=100−(intensity of elemental Sr for toner after freeing−intensity of elemental Sr for external additive-free toner)/(intensity of elemental Sr for toner before freeing−intensity of elemental Sr for external additive-free toner)×100

<Measurement of BET Specific Surface Areas of Toner, Toner Particles and External Additives>

Measurement of the specific surface areas by the BET method using nitrogen adsorption is carried out in accordance with JIS Z8830 (2001). The measurement apparatus used may be, for example, the TriStar 3000, which is an automated specific surface area and porosimetry analyzer (Shimadzu Corporation) that employs constant volume gas adsorption as the method of measurement.

EXAMPLES

The invention is described more fully below by way of working examples and comparative examples, although the invention is in no way limited thereby. Unless noted otherwise, all references in the working examples and the comparative examples to parts and % are by mass.

Examples of the Preparation of Magnetic Materials

Magnetic Material 1

An aqueous solution containing ferrous hydroxide was prepared by mixing, in an aqueous solution of ferrous sulfate: 1.00 to 1.10 equivalents of sodium hydroxide solution (elemental iron basis), $P_2O_5$ in an amount corresponding to 0.12 mass % (elemental phosphorus to elemental iron basis), and $SiO_2$ in an amount corresponding to 0.60 mass % (elemental silicon to elemental iron basis). The pH of the aqueous solution was set to 8.0 and an oxidation reaction was carried out at 85° C. while blowing in air, thereby preparing a slurry containing seed crystals.

Next, an aqueous solution of ferrous sulfate was added to this slurry in an amount corresponding to 0.90 to 1.20 equivalents with respect to the initial amount of alkali (sodium component of sodium hydroxide). The slurry was then maintained at pH 7.6 and the oxidation reaction was made to proceed while blowing in air, giving a slurry containing magnetic iron oxide. Following filtration and washing, this water-containing slurry was temporarily removed. At this time, a small amount of the water-containing sample was collected and the water content was measured. The water-containing sample was then poured, without drying, into another aqueous medium and stirred, the slurry was re-dispersed therein with a pin mill while being circulated, and the pH of the re-dispersion was adjusted to about 4.8. Next, 1.7 mass parts of n-hexyltrimethoxysilane coupling agent per 100 mass parts of magnetic iron oxide (the amount of magnetic iron oxide was calculated as the value obtained by subtracting the water content from the water-containing sample) was added under stirring, thereby carrying out hydrolysis. Stirring was then thoroughly carried out, the pH of the dispersion was set to 8.6, and surface treatment was carried out. The hydrophobic magnetic material thus produced was filtered with a filter press and rinsed with excess water, then dried at 100° C. for 15 minutes and at 90° C. for 30 minutes. The resulting particles were subjected to pulverizing treatment, giving Magnetic Material 1 having a volume-average particle diameter of 0.23 μm.

Magnetic Material 2

Aside from not adding phosphorus and mixing in $SiO_2$ in an amount corresponding to 0.40 mass % (elemental silicon basis), a slurry was prepared in the same way as in the preparation of Magnetic Material 1. The oxidation reaction was made to proceed in the same way as the preparation of Magnetic Material 1, thereby giving a slurry containing magnetic iron oxide.

Following filtration, washing and drying, the resulting particles were subjected to pulverizing treatment, giving Magnetic Material 2 having a volume-average particle diameter of 0.21 μm.

Example of the Preparation of a Polyester Resin

A reactor fitted with a condenser, a stirrer and a nitrogen inlet was charged with the following ingredients, and the reaction was carried out for 10 hours at 230° C. and under a stream of nitrogen while distilling off water that forms.

Bisphenol A 2-mole propylene oxide adduct
75 mass parts
Bisphenol A 3-mole propylene oxide adduct
25 mass parts
Terephthalic acid 110 mass parts
Titanium catalyst (titanium dihydroxybis (triethanolaminate)) 0.25 mass part Next, the reaction was carried out under a pressure of 5 to 20 mmHg. When the acid value had fallen to 2 mg KOH/g or less, the system was cooled to 180° C., 8 mass parts of trimellitic anhydride was added, and the reaction was carried out for 2 hours at standard temperature and under closed conditions. The product was then removed, cooled to room temperature and pulverized, giving Polyester Resin 1. The resulting Polyester Resin 1 had a main peak molecular weight (Mp), as measured by gel permeation chromatography (GPC), of 9,500.

Toner Particle Production Example 1

An aqueous medium containing a dispersion stabilizer was obtained by pouring 450 mass parts of a 0.1-M aqueous solution of $Na_3PO_4$ into 720 mass parts of ion-exchanged water and warming to 60° C., then adding 67.7 mass parts of a 1.0-M aqueous solution of $CaCl_2$.

Styrene 78.0 mass parts
n-Butyl acrylate 22.0 mass parts
Divinylbenzene 0.6 mass part
Iron complex of monoazo dye (T-77: from Hodogaya Chemical Co., Ltd.)
2.0 mass parts
Magnetic Material 1 90.0 mass parts
Polyester Resin 1 3.0 mass parts A polymerizable monomer composition was obtained by uniformly dispersing and mixing the above formulation using an attritor (Mitsui Miike Chemical Engineering Machinery). The resulting polymerizable monomer composition was warmed to 60° C. and 15.0 mass parts of Fischer-Tropsche wax (melting point, 74° C.; number-average molecular weight Mn, 500) was added, mixed and dissolved, following which 7.0 mass parts of dilauroyl peroxide was dissolved as a polymerization initiator, giving a toner composition.

The toner composition was poured into the above aqueous medium, then agitated at 12,500 rpm for 12 minutes in a TK Homomixer (Tokushu Kika Kogyo KK) at 60° C. and in a nitrogen atmosphere, and thereby granulated. Next, the reaction was carried out at 74° C. for 6 hours under stirring with a paddle-type stirring blade.

Following reaction completion, the suspension was cooled, hydrochloric acid was added and cleaning was carried out, followed by filtration and drying, giving Toner Particle 1. The physical properties of the resulting Toner Particle 1 are shown in Table 1.

Toner Particle Production Examples 2 and 3

Aside from lowering the rotational speed of the homomixer from 12,500 rpm to 10,500 rpm and 9,500 rpm respectively, the same procedure was carried out as in Toner Particle Production Example 1, thereby producing Toner Particles 2 and 3. The physical properties of the resulting Toner Particles 2 and 3 are shown in Table 1.

Toner Particle Production Example 4

Styrene-acrylate copolymer 100 mass parts (mass ratio of styrene to n-butyl acrylate=78.0:22.0;
main peak molecular weight Mp, 10,000)
Magnetic Material 2 90 mass parts
Iron complex of monoazo dye (T-77: from Hodogaya Chemical Co., Ltd.)
2.0 mass parts
Fischer-Tropsche wax 4 mass parts (melting point, 74° C.; number-average molecular weight Mn, 500)

The above formulation was premixed in a Henschel mixer, then melt-kneaded in a twin-screw extruder heated to 110° C. The cooled blend was coarsely pulverized in a hammer mill, giving a coarsely pulverized toner. This coarsely pulverized material was mechanically ground (finely pulverized) in a mechanical mill (a Turbo Mill from Turbo Kogyo Co.; the rotor and stator surfaces are coated with a chromium carbide-containing chromium alloy plating (plating thickness, 150 μm; surface hardness, HV 1050)). Fines and coarse material were then removed at the same time by classifying the finely pulverized material with a multi-grade classifier (an elbow-jet classifier manufactured by Nittetsu Mining Co., Ltd.) that utilizes the Coanda effect, thereby giving Toner Particle A.

Heat sphering treatment was carried out on this Toner Particle A. The heat sphering treatment was carried out using a Surface Fusing System (Nippon Pneumatic Mfg. Co., Ltd.). The operating conditions for the heat sphering apparatus were set as follows: feed rate, 5 kg/hr; hot air current temperature C, 260° C.; hot air current flow rate, 6 $m^3$/min; cooling air temperature E, 5° C.; cooling air flow rate, 4 $m^3$/min; absolute moisture content of cooling air, 3 g/$m^3$; blower air current rate, 20 $m^3$/min; injection air flow rate, 1 $m^3$/min; diffusing air flow rate, 0.3 $m^3$/min.

Through surface treatment under the above conditions, Toner Particle 4 having a weight-average particle diameter (D4) of 8.2 μm was obtained. The physical properties of the Toner Particle 4 thus obtained are shown in Table 1.

Toner Particle Production Example 5

The Toner Particle A obtained in Toner Particle Production Example 4 was subjected to surface modification and the removal of fines using a surface modifying apparatus (the Faculty, manufactured by Hosokawa Micron), thereby giving Toner Particle 5. The surface modification and fines removal conditions using the Faculty surface modifying apparatus were set as follows: the rotational velocity of the dispersion rotor was set to 200 m/sec, the amount of finely pulverized material charged per cycle was set to 6 kg, and the surface modification time (cycle time: time from when raw material feeding is completed until the discharge valve opens) was set to 90 seconds. The temperature at the time of toner particle discharge was 45° C. The physical properties of the Toner Particle 5 obtained are shown in Table 1. When the true densities for Toner Particles 1 to 5 were measured, all were 1.6 g/cm$^3$.

TABLE 1

Toner Particle Properties

| | D4 (μm) | Average circularity (—) | BET (m$^2$/g) |
|---|---|---|---|
| Toner Particle 1 | 8.0 | 0.972 | 0.62 |
| Toner Particle 2 | 8.2 | 0.968 | 0.60 |
| Toner Particle 3 | 7.9 | 0.962 | 0.64 |
| Toner Particle 4 | 8.2 | 0.951 | 0.70 |
| Toner Particle 5 | 7.8 | 0.948 | 0.95 |

Silica Fine Particle Production Example 1

Dry, untreated silica (average primary particle diameter=9 nm) was charged into an autoclave equipped with a stirrer, and heated to 200° C. in a fluidized state effected by stirring.

The interior of the reactor was flushed with nitrogen gas, following which the reactor was closed, the interior was sprayed with 25 mass parts of hexamethyldisilazane per 100 mass parts of dry silica, and silane compound treatment was carried out under a silica fluidized state. After continuing this reaction for 60 minutes, the reaction was completed. Following reaction completion, the autoclave was depressurized, cleaning with a stream of nitrogen gas was carried out, then excess hexamethyldisilazane and by-products were removed from the hydrophobic silica.

In addition, while the interior of the reactor was stirred, 10 mass parts of dimethyl silicone oil (viscosity=100 mm$^2$/s) per 100 mass parts of the dry silica was sprayed. After stirring had been continued for 30 minutes, the temperature was raised to 300° C. under stirring, stirring was continued for another 2 hours, then the reactor contents were removed and disaggregation treatment was carried out, giving Silica Fine Particle 1. The properties of Silica Fine Particle 1 are shown in Table 2.

Silica Fine Particle Production Examples 2 to 8

Aside from changing the particle diameter of the untreated silica used and suitably adjusting the strength of disaggregation treatment, Silica Fine Particles 2 to 8 were obtained in the same way as in Silica Fine Particle Production Example 1. The properties of Silica Fine Particles 2 to 8 are shown in Table 2. The true densities of Silica Fine Particles 1 to 8 were measured and all were found to be 2.2 g/cm$^2$.

TABLE 2

Silica Fine Particle Properties

| | Number-average particle diameter D1 (nm) of primary particles | BET (m$^2$/g) | Bulk density (g/L) |
|---|---|---|---|
| Silica Fine Particle 1 | 9 | 130 | 30 |
| Silica Fine Particle 2 | 5 | 200 | 48 |
| Silica Fine Particle 3 | 7 | 180 | 22 |

TABLE 2-continued

Silica Fine Particle Properties

| | Number-average particle diameter D1 (nm) of primary particles | BET (m$^2$/g) | Bulk density (g/L) |
|---|---|---|---|
| Silica Fine Particle 4 | 15 | 80 | 38 |
| Silica Fine Particle 5 | 20 | 60 | 16 |
| Silica Fine Particle 6 | 9 | 130 | 10 |
| Silica Fine Particle 7 | 9 | 130 | 60 |
| Silica Fine Particle 8 | 25 | 50 | 15 |

Strontium Titanate Fine Particle Production Examples 1 to 6

Hydrous titanium oxide obtained by hydrolyzing an aqueous solution of titanyl sulfate was washed with pure water until the electrical conductivity of the filtrate became 2,200 μS/cm. NaOH was added to this hydrous titanium oxide slurry until the content of adsorbed sulfate radicals as $SO_3$ became 0.24%. Hydrochloric acid was then added to the hydrous titanium oxide slurry, bringing the pH to 1.0 and yielding a titania sol dispersion. NaOH was added to this titania sol dispersion, bringing the pH of the dispersion to 6.0, and the dispersion was washed by decantation with pure water until the electrical conductivity of the supernatant became 120 μS/cm.

Next, 533 g (0.6 mole) of the m-titanic acid having a moisture content of 91% thus obtained was placed in a stainless steel reactor and nitrogen gas was blown into the reactor, following which the reactor was left to stand for 20 minutes, thereby flushing the reactor interior with nitrogen gas. Next, 183.6 g (0.66 mole) of $Sr(OH)_2.8H_2O$ (purity, 95.5%) was added and distilled water was also added, thereby preparing a slurry containing 0.3 mole/L ($SrTiO_3$ basis) and having a $SrO/TiO_2$ molar ratio of 1.10.

The temperature of the slurry was raised to 90° C. in a nitrogen atmosphere and the reaction was carried out. Following the reaction, the slurry was cooled to 40° C., the supernatant was removed in a nitrogen atmosphere and washing was carried out by twice repeating the operations of adding 2.5 liters of pure water and decantation, following which filtration was carried out with a Buchner funnel. The resulting filter cake was dried 4 hours in open air at 110° C., thereby giving strontium titanate fine particles.

Next, 100 parts of strontium titanate fine particles was added to an aqueous solution of sodium stearate (7 parts of sodium stearate and 100 parts of water) as the fatty acid metal salt. An aqueous solution of aluminum sulfate was added dropwise thereto under stirring, causing aluminum stearate to settle out and deposit on the surface of the strontium titanate fine particles and thereby producing strontium titanate treated with stearic acid. In addition, by lengthening the reaction time after raising the temperature of this slurry to 90° C., the particle size was increased, thereby producing Strontium Titanate Fine Particles 1 to 6 of the target particle diameters. The physical properties of Strontium Titanate Fine Particles 1 to 6 are shown in Table 3.

Strontium Titanate Fine Particle Production Example 7

Strontium carbonate (600 g) and titanium oxide (320 g) were dry mixed for 8 hours in a ball mill, then filtered and dried. This mixture was compacted under a pressure of 5 kg/cm, and then pre-fired for 8 hours at 1100° C. The fired material was mechanically pulverized, giving Strontium Titanium Fine Particle 7 having a number-average particle diameter of 500 nm. The properties of the Strontium Titanate Fine Particle 7 are shown in Table 3.

TABLE 3

Properties of Strontium Titanate Fine Particles ("ST Fine Particles" in table)

| | Number-average particle diameter D1 (nm) of primary particles | BET ($m^2/g$) |
|---|---|---|
| ST Fine Particle 1 | 120 | 8 |
| ST Fine Particle 2 | 60 | 15 |
| ST Fine Particle 3 | 82 | 11 |
| ST Fine Particle 4 | 145 | 6 |
| ST Fine Particle 5 | 194 | 4.5 |
| ST Fine Particle 6 | 50 | 17 |
| ST Fine Particle 7 | 500 | 5 |

Toner Production Example 1

Using the apparatus shown in FIG. 3, external addition and mixing treatment was carried out on Toner Particle 1 obtained in Toner Particle Production Example 1.

In this example, using as the apparatus shown in FIG. 3 an apparatus in which the inner peripheral portion of the body casing 1 has a diameter of 130 mm and the treatment space 9 has a capacity of $2.0\times10^{-3}$ $m^3$, the rated power for the drive unit 8 was set to 5.5 kW and the shape of the stirring members 3 was as shown in FIG. 4. In addition, the overlap width d of the forward transport stirring members 3*a* and the backward transport stirring members 3*b* in FIG. 4 was set to 0.25 D (relative to the maximum width D of the stirring members 3), and the clearance between the stirring members 3 and the inner periphery of the body casing 1 was set to 3.0 mm.

The apparatus shown in FIG. 3 having the above-described configuration was charged with 100 mass parts of Toner Particle 1, 0.40 mass part of silica fine particles that were subjected to hydrophobic treatment with silicone oil and a silane coupling agent, and 0.30 mass part of Strontium Titanate Fine Particle 1.

After the toner particles, the silica fine particles and the strontium titanate fine particles had been charged into the apparatus, pre-mixing was carried out in order to uniformly mix together the toner particles, silica fine particles and strontium titanate fine particles. The pre-mixing conditions were as follows: the power of the drive unit 8 was set to 0.10 W/g (rotational speed of drive unit 8: 150 rpm), and the treatment time was set to 1 minute.

Following the completion of pre-mixing, external addition and mixing treatment was carried out. The external addition and mixing treatment conditions were as follows: the peripheral velocity at the outermost tip of the stirring member 3 was adjusted so as to keep the power of the drive unit 8 constant at 0.60 W/g (rotational velocity of drive unit 8, 1,400 rpm), and the treatment time was set to 3 minutes.

Next, an additional 0.10 mass part of silica fine particles was added (bringing the total mass to 0.50 mass part, with respect to the toner particles), the peripheral velocity at the outermost tip of the stirring member 3 was adjusted so as to keep the power of the drive unit 8 constant at 0.60 W/g (rotational velocity of drive unit 8, 1,400 rpm), and another 2 minutes of treatment was carried out.

Following external addition and mixing treatment, the coarse particles were removed with a circular oscillating sieve equipped with a screen having a 500 mm diameter and 75 μm openings, thereby giving Toner 1. Toner 1 was magnified and examined with a scanning electron microscope, and the number-average particle diameter of primary particles of the silica fine particles on the surfaces of the toner particles was measured and found to be 9 nm. The number-average particle diameter of primary particles of the strontium titanate fine particles on the surfaces of the toner particles was measured and found to be 120 nm. The external addition conditions and physical properties for Toner 1 are shown in Table 4.

<Production of Toners 2 to 30 According to the Invention and Comparative Toners 1 to 12>

Aside from changing the type and amount of external additive added, the toner particles, the external addition apparatus and the external addition conditions as shown in Tables 2, 3 and 4, the same procedure was carried out as in the production of Toner 1 of the invention, thereby giving Toners 2 to 30 and Comparative Toners 1 to 12. The external addition conditions for the toners obtained are shown in Tables 4 and 5, and the physical properties are shown in Table 6.

Here, in cases where use is made of a Henschel mixer as the external addition apparatus, an FM10C Henschel mixer (Mitsui Miike Chemical Engineering Machinery) was employed. Also, the pre-mixing step was not carried out in some of the production examples.

TABLE 4

| | | | | First-stage external addition conditions | | | Second-stage external addition conditions | |
|---|---|---|---|---|---|---|---|---|
| | | External addition apparatus | Pre-mixing conditions | Amount of silica fine particles added (mass parts) | Amount of strontium titanate (ST) fine particles added (mass parts) | First-stage external addition conditions | Amount of silica fine particles added (mass parts) | Second-stage external addition conditions |
| Toner 1 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.1) | 0.60 W/g (1400 rpm) · 2 min |
| Toner 2 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.2) | 0.60 W/g (1400 rpm) · 2 min |
| Toner 3 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.3) | 0.60 W/g (1400 rpm) · 2 min |
| Toner 4 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.4) | 0.60 W/g (1400 rpm) · 2 min |
| Toner 5 | Toner Particle 1 | FIG. 3 apparatus | 0.10 W/g (150 rpm) · 1 min | Silica Fine Particle 1 (0.2) | ST Fine Particle 1 (0.3) | 0.60 W/g (1400 rpm) · 3 min | Silica Fine Particle 1 (0.3) | 0.60 W/g (1400 rpm) · 2 min |
| Toner 6 | Toner Particle 1 | FIG. 3 apparatus | 0.10 W/g (150 rpm) · 1 min | Silica Fine Particle 1 (0.3) | ST Fine Particle 1 (0.3) | 0.60 W/g (1400 rpm) · 3 min | Silica Fine Particle 1 (0.2) | 0.60 W/g (1400 rpm) · 2 min |

TABLE 4-continued

| | | | | First-stage external addition conditions | | | Second-stage external addition conditions | |
|---|---|---|---|---|---|---|---|---|
| | | External addition apparatus | Pre-mixing conditions | Amount of silica fine particles added (mass parts) | Amount of strontium titanate (ST) fine particles added (mass parts) | First-stage external addition conditions | Amount of silica fine particles added (mass parts) | Second-stage external addition conditions |
| Toner 7 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.1) | 0.60 W/g (1400 rpm) · 2 min |
| Toner 8 | Toner Particle 1 | FIG. 3 apparatus | 0.10 W/g (150 rpm) · 1 min | Silica Fine Particle 1 (0.4) | ST Fine Particle 1 (0.3) | 0.60 W/g (1400 rpm) · 4 min | Silica Fine Particle 1 (0.1) | 0.60 W/g (1400 rpm) · 1 min |
| Toner 9 | Toner Particle 1 | FIG. 3 apparatus | 0.06 W/g (50 rpm) · 1 min | Silica Fine Particle 1 (0.4) | ST Fine Particle 1 (0.3) | 0.60 W/g (1400 rpm) · 3 min | Silica Fine Particle 1 (0.2) | 0.60 W/g (1400 rpm) · 2 min |
| Toner 10 | Toner Particle 1 | FIG. 3 apparatus | 0.06 W/g (50 rpm) · 1 min | Silica Fine Particle 1 (0.4) | ST Fine Particle 1 (0.3) | 0.60 W/g (1400 rpm) · 3 min | Silica Fine Particle 1 (0.3) | 0.60 W/g (1400 rpm) · 2 min |
| Toner 11 | Toner Particle 1 | FIG. 3 apparatus | 0.10 W/g (150 rpm) · 1 min | Silica Fine Particle 1 (0.4) | ST Fine Particle 2 (0.3) | 0.60 W/g (1400 rpm) · 3 min | Silica Fine Particle 1 (0.3) | 0.60 W/g (1400 rpm) · 2 min |
| Toner 12 | Toner Particle 1 | FIG. 3 apparatus | 0.10 W/g (150 rpm) · 1 min | Silica Fine Particle 1 (0.4) | ST Fine Particle 3 (0.3) | 0.60 W/g (1400 rpm) · 3 min | Silica Fine Particle 1 (0.3) | 0.60 W/g (1400 rpm) · 2 min |
| Toner 13 | Toner Particle 1 | FIG. 3 apparatus | 0.10 W/g (150 rpm) · 1 min | Silica Fine Particle 1 (0.4) | ST Fine Particle 4 (0.3) | 0.60 W/g (1400 rpm) · 3 min | Silica Fine Particle 1 (0.3) | 0.60 W/g (1400 rpm) · 2 min |
| Toner 14 | Toner Particle 1 | FIG. 3 apparatus | 0.10 W/g (150 rpm) · 1 min | Silica Fine Particle 1 (0.4) | ST Fine Particle 5 (0.3) | 0.60 W/g (1400 rpm) · 3 min | Silica Fine Particle 1 (0.3) | 0.60 W/g (1400 rpm) · 2 min |
| Toner 15 | Toner Particle 1 | FIG. 3 apparatus | 0.10 W/g (150 rpm) · 1 min | Silica Fine Particle 2 (0.4) | ST Fine Particle 1 (0.3) | 0.60 W/g (1400 rpm) · 3 min | Silica Fine Particle 2 (0.3) | 0.60 W/g (1400 rpm) · 2 min |
| Toner 16 | Toner Particle 1 | FIG. 3 apparatus | 0.10 W/g (150 rpm) · 1 min | Silica Fine Particle 3 (0.4) | ST Fine Particle 1 (0.3) | 0.60 W/g (1400 rpm) · 3 min | Silica Fine Particle 3 (0.3) | 0.60 W/g (1400 rpm) · 2 min |
| Toner 17 | Toner Particle 1 | FIG. 3 apparatus | 0.10 W/g (150 rpm) · 1 min | Silica Fine Particle 4 (0.4) | ST Fine Particle 1 (0.3) | 0.60 W/g (1400 rpm) · 3 min | Silica Fine Particle 4 (0.3) | 0.60 W/g (1400 rpm) · 2 min |
| Toner 18 | Toner Particle 1 | FIG. 3 apparatus | 0.10 W/g (150 rpm) · 1 min | Silica Fine Particle 5 (0.4) | ST Fine Particle 1 (0.3) | 0.60 W/g (1400 rpm) · 3 min | Silica Fine Particle 5 (0.3) | 0.60 W/g (1400 rpm) · 2 min |
| Toner 19 | Toner Particle 1 | FIG. 3 apparatus | 0.10 W/g (150 rpm) · 1 min | Silica Fine Particle 1 (0.4) | ST Fine Particle 1 (0.6) | 0.60 W/g (1400 rpm) · 3 min | Silica Fine Particle 1 (0.3) | 0.60 W/g (1400 rpm) · 2 min |
| Toner 20 | Toner Particle 1 | FIG. 3 apparatus | 0.10 W/g (150 rpm) · 1 min | Silica Fine Particle 1 (0.4) | ST Fine Particle 1 (0.1) | 0.60 W/g (1400 rpm) · 3 min | Silica Fine Particle 1 (0.3) | 0.60 W/g (1400 rpm) · 2 min |
| Toner 21 | Toner Particle 1 | FIG. 3 apparatus | 0.10 W/g (150 rpm) · 1 min | Silica Fine Particle 1 (0.4) | ST Fine Particle 1 (1.0) | 0.60 W/g (1400 rpm) · 3 min | Silica Fine Particle 1 (0.3) | 0.60 W/g (1400 rpm) · 2 min |
| Toner 22 | Toner Particle 1 | FIG. 3 apparatus | 0.10 W/g (150 rpm) · 1 min | Silica Fine Particle 1 (0.4) | ST Fine Particle 1 (1.2) | 0.60 W/g (1400 rpm) · 3 min | Silica Fine Particle 1 (0.3) | 0.60 W/g (1400 rpm) · 2 min |
| Toner 23 | Toner Particle 1 | FIG. 3 apparatus | 0.06 W/g (50 rpm) · 1 min | Silica Fine Particle 1 (0.4) | ST Fine Particle 1 (1.2) | 0.60 W/g (1400 rpm) · 3 min | Silica Fine Particle 1 (0.3) | 0.60 W/g (1400 rpm) · 2 min |
| Toner 24 | Toner Particle 1 | FIG. 3 apparatus | 0.06 W/g (50 rpm) · 1 min | Silica Fine Particle 1 (0.4) | ST Fine Particle 1 (1.2) | 0.60 W/g (1400 rpm) · 3 min | Silica Fine Particle 1 (0.3) | 0.60 W/g (1400 rpm) · 2 min |
| Toner 25 | Toner Particle 1 | FIG. 3 apparatus | 0.06 W/g (50 rpm) · 1 min | Silica Fine Particle 1 (0.2) | ST Fine Particle 1 (1.2) | 1.00 W/g (1800 rpm) · 3 min | Silica Fine Particle 1 (0.5) | 0.60 W/g (1400 rpm) · 2 min |
| Toner 26 | Toner Particle 1 | FIG. 3 apparatus | 0.06 W/g (50 rpm) · 1 min | Silica Fine Particle 1 (0.2) | ST Fine Particle 1 (1.2) | 0.60 W/g (1400 rpm) · 1 min | Silica Fine Particle 1 (0.5) | 0.60 W/g (1400 rpm) · 4 min |
| Toner 27 | Toner Particle 2 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.3) | 0.60 W/g (1400 rpm) · 2 min |
| Toner 28 | Toner Particle 3 | FIG. 3 apparatus | 0.10 W/g (150 rpm) · 1 min | Silica Fine Particle 1 (0.4) | ST Fine Particle 1 (0.3) | 0.60 W/g (1400 rpm) · 3 min | Silica Fine Particle 1 (0.3) | 0.60 W/g (1400 rpm) · 2 min |
| Toner 29 | Toner Particle 4 | FIG. 3 apparatus | 0.10 W/g (150 rpm) · 1 min | Silica Fine Particle 1 (0.5) | ST Fine Particle 1 (0.3) | 0.60 W/g (1400 rpm) · 3 min | Silica Fine Particle 1 (0.3) | 0.60 W/g (1400 rpm) · 2 min |
| Toner 30 | Toner Particle 5 | FIG. 3 apparatus | 0.10 W/g (150 rpm) · 1 min | Silica Fine Particle 1 (0.7) | ST Fine Particle 1 (1.2) | 0.60 W/g (1400 rpm) · 3 min | Silica Fine Particle 1 (0.3) | 0.60 W/g (1400 rpm) · 2 min |

TABLE 5

| Comparative Toners | | | | | | | | |
|---|---|---|---|---|---|---|---|---|
| | | | | First-stage external addition conditions | | | Second-stage external addition conditions | |
| | | External addition apparatus | Pre-mixing conditions | Amount of silica fine particles added (mass parts) | Amount of strontium titanate (ST) fine particles added (mass parts) | First-stage external addition conditions | Amount of silica fine particles added (mass parts) | Second-stage external addition conditions |
| Comparative Toner 1 | Toner Particle 1 | FIG. 3 apparatus | 0.10 W/g (150 rpm) · 1 min | Silica Fine Particle 1 (0.2) | ST Fine Particle 1 (0.3) | 0.60 W/g (1400 rpm) · 2 min | Silica Fine Particle 1 (0.4) | 0.60 W/g (1400 rpm) ·3 min |
| Comparative Toner 2 | Toner Particle 1 | FIG. 3 apparatus | 0.10 W/g (150 rpm) · 1 min | Silica Fine Particle 1 (0.4) | ST Fine Particle 1 (0.3) | 0.80 W/g (1600 rpm) · 4 min | Silica Fine Particle 1 (0.2) | 0.60 W/g (1400 rpm) · 1 min |

TABLE 5-continued

| Comparative Toners | | | | | | | | |
|---|---|---|---|---|---|---|---|---|
| | | | | First-stage external addition conditions | | | Second-stage external addition conditions | |
| | | External addition apparatus | Pre-mixing conditions | Amount of silica fine particles added (mass parts) | Amount of strontium titanate (ST) fine particles added (mass parts) | First-stage external addition conditions | Amount of silica fine particles added (mass parts) | Second-stage external addition conditions |
| Comparative Toner 3 | Toner Particle 1 | Henschel mixer | no pre-mixing | Silica Fine Particle 1 (0.6) | ST Fine Particle 1 (0.3) | 4000 rpm · 3 min | none | no second-stage external addition |
| Comparative Toner 4 | Toner Particle 1 | Henschel mixer | no pre-mixing | Silica Fine Particle 1 (0.75) | ST Fine Particle 1 (0.3) | 4000 rpm · 3 min | none | no second-stage external addition |
| Comparative Toner 5 | Toner Particle 1 | Henschel mixer | no pre-mixing | Silica Fine Particle 2 (0.7) | ST Fine Particle 1 (0.3) | 4000 rpm · 3 min | none | no second-stage external addition |
| Comparative Toner 6 | Toner Particle 1 | Henschel mixer | no pre-mixing | Silica Fine Particle 5 (1.2) | ST Fine Particle 1 (0.3) | 4000 rpm · 3 min | none | no second-stage external addition |
| Comparative Toner 7 | Toner Particle 1 | FIG. 3 apparatus | 0.10 W/g (150 rpm) · 1 min | Silica Fine Particle 1 (0.3) | ST Fine Particle 1 (0.3) | 0.60 W/g (1400 rpm) · 3 min | Silica Fine Particle 1 (0.1) | 0.60 W/g (1400 rpm) · 2 min |
| Comparative Toner 8 | Toner Particle 1 | FIG. 3 apparatus | 0.10 W/g (150 rpm) · 1 min | Silica Fine Particle 8 (1.5) | ST Fine Particle 1 (0.3) | 0.60 W/g (1400 rpm) · 3 min | Silica Fine Particle 8 (0.7) | 0.60 W/g (1400 rpm) · 2 min |
| Comparative Toner 9 | Toner Particle 1 | FIG. 3 apparatus | 0.10 W/g (150 rpm) · 1 min | Silica Fine Particle 1 (0.4) | ST Fine Particle 6 (0.3) | 0.60 W/g (1400 rpm) · 3 min | Silica Fine Particle 1 (0.3) | 0.60 W/g (1400 rpm) · 2 min |
| Comparative Toner 10 | Toner Particle 1 | FIG. 3 apparatus | 0.10 W/g (150 rpm) · 1 min | Silica Fine Particle 1 (0.4) | ST Fine Particle 7 (0.3) | 0.60 W/g (1400 rpm) · 3 min | Silica Fine Particle 1 (0.3) | 0.60 W/g (1400 rpm) · 2 min |
| Comparative Toner 11 | Toner Particle 1 | Henschel mixer | 200 rpm · 1 min | Silica Fine Particle 1 (0.4) | ST Fine Particle 1 (0.3) | 4000 rpm · 2 min | Silica Fine Particle 1 (0.3) | 4000 rpm · 1 min |
| Comparative Toner 12 | Toner Particle 1 | FIG. 3 apparatus | 0.30 W/g (600 rpm) · 1 min | Silica Fine Particle 1 (0.4) | ST Fine Particle 1 (0.3) | 0.60 W/g (1400 rpm) · 3 min | Silica Fine Particle 1 (0.3) | 0.60 W/g (1400 rpm) · 2 min |

TABLE 6

| | Toner BET ($m^2/g$) | Free ratio (%) of ST fine particles | Coverage ratio X1 (%) | Theoretical coverage ratio X2 (%) | Diffusion index (—) | Diffusion index lower limit (—) | External additive embedding ratio (%) |
|---|---|---|---|---|---|---|---|
| Toner 1 | 1.05 | 45 | 45 | 89 | 0.51 | 0.43 | 36 |
| Toner 2 | 1.12 | 45 | 50 | 106 | 0.47 | 0.41 | 38 |
| Toner 3 | 1.15 | 45 | 58 | 124 | 0.47 | 0.38 | 43 |
| Toner 4 | 1.16 | 45 | 70 | 141 | 0.49 | 0.33 | 49 |
| Toner 5 | 1.12 | 58 | 48 | 89 | 0.54 | 0.42 | 26 |
| Toner 6 | 1.08 | 46 | 46 | 89 | 0.52 | 0.43 | 32 |
| Toner 7 | 0.93 | 40 | 43 | 89 | 0.48 | 0.44 | 54 |
| Toner 8 | 0.89 | 30 | 41 | 89 | 0.46 | 0.45 | 60 |
| Toner 9 | 1.15 | 45 | 46 | 106 | 0.43 | 0.43 | 34 |
| Toner 10 | 1.18 | 45 | 51 | 124 | 0.41 | 0.41 | 40 |
| Toner 11 | 1.14 | 21 | 58 | 124 | 0.47 | 0.38 | 46 |
| Toner 12 | 1.12 | 29 | 57 | 124 | 0.46 | 0.38 | 47 |
| Toner 13 | 1.11 | 62 | 56 | 124 | 0.45 | 0.38 | 47 |
| Toner 14 | 1.10 | 68 | 55 | 124 | 0.44 | 0.39 | 48 |
| Toner 15 | 1.25 | 44 | 75 | 223 | 0.34 | 0.31 | 56 |
| Toner 16 | 1.22 | 42 | 64 | 159 | 0.40 | 0.35 | 53 |
| Toner 17 | 1.05 | 39 | 46 | 74 | 0.62 | 0.43 | 26 |
| Toner 18 | 0.94 | 38 | 43 | 56 | 0.77 | 0.44 | 28 |
| Toner 19 | 1.17 | 55 | 58 | 124 | 0.47 | 0.38 | 43 |
| Toner 20 | 1.15 | 38 | 57 | 124 | 0.46 | 0.38 | 42 |
| Toner 21 | 1.20 | 63 | 56 | 124 | 0.45 | 0.38 | 41 |
| Toner 22 | 1.23 | 69 | 54 | 124 | 0.44 | 0.39 | 39 |
| Toner 23 | 1.33 | 68 | 53 | 124 | 0.43 | 0.40 | 29 |
| Toner 24 | 1.04 | 68 | 51 | 124 | 0.41 | 0.41 | 58 |
| Toner 25 | 1.05 | 15 | 51 | 124 | 0.41 | 0.41 | 57 |
| Toner 26 | 1.03 | 75 | 51 | 124 | 0.41 | 0.41 | 59 |
| Toner 27 | 1.18 | 45 | 54 | 127 | 0.43 | 0.39 | 38 |
| Toner 28 | 1.20 | 45 | 51 | 122 | 0.42 | 0.41 | 40 |
| Toner 29 | 1.20 | 50 | 60 | 145 | 0.41 | 0.37 | 53 |
| Toner 30 | 1.80 | 72 | 65 | 172 | 0.38 | 0.35 | 39 |
| Comparative Toner 1 | 1.25 | 58 | 52 | 106 | 0.49 | 0.40 | 22 |
| Comparative Toner 2 | 0.92 | 32 | 48 | 106 | 0.45 | 0.42 | 63 |

TABLE 6-continued

| | Toner BET ($m^2/g$) | Free ratio (%) of ST fine particles | Coverage ratio X1 (%) | Theoretical coverage ratio X2 (%) | Diffusion index (—) | Diffusion index lower limit (—) | External additive embedding ratio (%) |
|---|---|---|---|---|---|---|---|
| Comparative Toner 3 | 1.01 | 32 | 43 | 106 | 0.40 | 0.44 | 51 |
| Comparative Toner 4 | 1.19 | 44 | 51 | 133 | 0.38 | 0.41 | 43 |
| Comparative Toner 5 | 1.25 | 44 | 70 | 223 | 0.31 | 0.33 | 56 |
| Comparative Toner 6 | 0.95 | 40 | 41 | 95 | 0.43 | 0.45 | 56 |
| Comparative Toner 7 | 1.00 | 43 | 37 | 71 | 0.52 | 0.46 | 30 |
| Comparative Toner 8 | 1.10 | 38 | 40 | 138 | 0.29 | 0.45 | 56 |
| Comparative Toner 9 | 1.15 | 22 | 56 | 124 | 0.45 | 0.38 | 45 |
| Comparative Toner 10 | 1.13 | 68 | 54 | 124 | 0.44 | 0.39 | 44 |
| Comparative Toner 11 | 1.25 | 35 | 42 | 124 | 0.34 | 0.44 | 33 |
| Comparative Toner 12 | 1.15 | 32 | 46 | 124 | 0.37 | 0.43 | 43 |

In the above table, "Diffusion index lower limit (–)" refers to the value of (–0.0042×X1+0.62) in Formula 2.

Example 1

An LBP-6300 (Canon Inc.) was used as the image-forming apparatus, and the process speed was increased about 1.5 times to 300 mm/sec.

The 14 mm diameter developing sleeve in the above apparatus was replaced with a developing sleeve having a diameter of 10 mm, the 24 mm diameter photosensitive member was replaced with a photosensitive member having a diameter of 18 mm, and the new developing sleeve and photosensitive member were each loaded into a toner cartridge. In addition, a modified cartridge was used in which the toner filling capacity was increased 1.2-fold and the cleaning blade contact pressure was lowered to about one-half the value at 3 kgf/m.

In the image-forming apparatus in which the small-diameter developing sleeve has been installed, the image density and fogging that result from toner deterioration can be rigorously evaluated by increasing the process speed. In addition, using the small-diameter photosensitive member, faulty cleaning can be rigorously evaluated by setting the cleaning blade pressure to a low value.

Using this modified apparatus and Toner 1, an 8,000-page printout test in which horizontal lines having a print percentage of 1% were printed out in a two-page intermittent mode was carried out in a high-temperature, high-humidity environment (32.5° C./80% RH).

As a result, before and after the durability test, it was possible to obtain images having a high density and little fogging in non-image areas. The evaluation results are shown in Table 7.

The methods used to carry out various evaluations in the examples and comparative examples and the rating criteria therefor employed in of the present invention are described below.

<Image Density>

The image density was evaluated by forming a solid black image area, and measuring the density of this solid black image with a Macbeth densitometer (from Macbeth).

The criteria for rating the reflection density of the solid back image at the start (first page) of use in a durability test are shown below.

A: Very good (not less than 1.45)
B: Good (not less than 1.40 and less than 1.45)
C: Fair (not less than 1.35 and less than 1.40)
D: Poor (less than 1.35)

The criteria for rating the image density in the last half of use in a durability test are shown below.

The smaller the difference between the reflection density of a solid black image at the start of use in a durability test and the reflection density of the solid black image after use in an 8,000-page durability test, the better the rating.

A: Very good (difference is less than 0.10)
B: Good (difference is not less than 0.10 and less than 0.15)
C: Fair (difference is not less than 0.15 and less than 0.20)
D: Poor (difference is not less than 0.20)

<Fogging>

A solid white image was output, and the reflectance was measured using a TC-6DS reflectometer from Tokyo Denshoku Co., Ltd. The reflectance of the transfer paper (standard paper) prior to formation of the solid white image was similarly measured. A green filter was used. The following formula was used to calculate fogging from the reflectance before and after output of the solid white image.

Fogging (reflectance)(%)=reflectance(%) of standard paper−reflectance(%) of solid white image sample The criteria for rating fogging are shown below.

A: Very good (less than 1.0%)
B: Good (not less than 1.0% and less than 1.5%)
C: Fair (not less than 1.5% and less than 2.5%)
D: Poor (not less than 2.5%)

[Evaluation of Cleaning Performance and Waste Toner Spillage]

To evaluate the cleaning performance, the same modified apparatus and modified cartridge were used, the cartridge was filled with fresh Toner 1, and a printout test was carried out in a low-temperature, low-humidity environment, (0° C., 10% RH).

First, a 3,000-page printout test was performed in which horizontal lines having a print percentage of 2% were printed out in a one-page intermittent mode. The apparatus was then left to stand overnight, after which 500 pages of horizontal line images having a print percentage of 2% were printed out once again the following day.

Next, 10 pages of solid white images were printed out and the cleaning performance was evaluated.

In addition, a test was carried out in which 5,000 pages of horizontal lines having a print percentage of 2% were printed out in a two-page intermittent mode, after which it was determined whether waste toner spillage had occurred. The evaluation results are shown in Table 7.

By carrying out a printout test in a low-temperature, low-humidity environment (0° C., 10% RH), the toner readily charges up, and faulty cleaning and waste toner spillage can be rigorously evaluated.

<Faulty Cleaning>

Evaluation of the cleaning performance was carried out by rating the degree of contamination on solid white images and the degree of contamination of the photosensitive member after solid white image printout.

A: Cleaning performance resulting in clear, totally problem-free picture quality on images, and complete absence of any contamination on photosensitive member B: Cleaning performance resulting in totally problem-free picture quality on images, but slight contamination observed on photosensitive member C: Cleaning performance that poses no practical problem D: Unacceptable cleaning performance resulting in contamination of images and photosensitive member <Waste Toner Spillage>

Evaluation of waste toner spillage was carried out by determining whether waste toner spillage occurs while printing out a total run of 8,500 pages of horizontal line images with a print percentage of 2% in a low-temperature, low-humidity environment (0° C., 10% RH). When waste toner spillage occurs, this appears as vertical streaks on the horizontal line images. As a result, with Toner 1, no waste toner spillage occurred and good images were obtained up until the end.

The rating criteria for waste toner spillage are shown below.

A: No waste toner spillage

B: Slight waste toner spillage arose, but the durability test was continued and recovery occurred on its own C: Slight waste toner spillage arose, but recovery occurred when the toner cartridge was shaken a little D: Waste toner spillage arose and recover did not occur even when the toner cartridge was shaken Examples 2 to 30, Comparative Examples 1 to 12

In Examples 2 to 30, evaluations were carried out in the same way as in Example 1, but using Toners 2 to 30 instead of Toner 1. Likewise, in Comparative Examples 1 to 12, evaluations were carried out using Comparative Toners 1 to 12. As a result, in substantially all the comparative toners, the image density during the last half of use in durability tests worsened to an undesirable level. The evaluation results are shown in Table 7.

TABLE 7

| | | Image density (start of durability test) | Image density (second half of durability test) | Fogging | Faulty cleaning | Waste toner spillage |
|---|---|---|---|---|---|---|
| Example 1 | Toner 1 | A (1.48) | A (0.06) | A (0.3) | A | A |
| Example 2 | Toner 2 | A (1.49) | A (0.05) | A (0.4) | A | A |
| Example 3 | Toner 3 | A (1.49) | A (0.05) | A (0.3) | A | A |
| Example 4 | Toner 4 | A (1.49) | A (0.05) | A (0.3) | A | A |
| Example 5 | Toner 5 | A (1.48) | A (0.06) | A (0.7) | A | A |
| Example 6 | Toner 6 | A (1.48) | A (0.06) | A (0.5) | A | A |
| Example 7 | Toner 7 | A (1.46) | A (0.08) | A (0.8) | A | A |
| Example 8 | Toner 8 | A (1.45) | A (0.09) | A (0.7) | B | A |
| Example 9 | Toner 9 | A (1.47) | A (0.09) | A (0.8) | A | A |
| Example 10 | Toner 10 | A (1.48) | A (0.08) | A (0.8) | A | A |
| Example 11 | Toner 11 | A (1.47) | A (0.08) | A (0.8) | A | A |
| Example 12 | Toner 12 | A (1.48) | A (0.06) | A (0.5) | A | A |
| Example 13 | Toner 13 | A (1.48) | A (0.05) | A (0.5) | A | A |
| Example 14 | Toner 14 | A (1.47) | A (0.08) | A (0.7) | A | A |
| Example 15 | Toner 15 | A (1.48) | A (0.09) | A (0.6) | A | A |
| Example 16 | Toner 16 | A (1.48) | A (0.06) | A (0.5) | A | A |
| Example 17 | Toner 17 | A (1.47) | A (0.06) | A (0.6) | A | A |
| Example 18 | Toner 18 | A (1.47) | A (0.09) | A (0.8) | A | A |
| Example 19 | Toner 19 | A (1.48) | A (0.05) | A (0.6) | A | A |
| Example 20 | Toner 20 | A (1.48) | A (0.06) | A (0.5) | A | A |
| Example 21 | Toner 21 | A (1.48) | A (0.08) | A (0.7) | A | A |
| Example 22 | Toner 22 | A (1.47) | A (0.09) | A (0.9) | A | A |
| Example 23 | Toner 23 | A (1.47) | A (0.08) | B (1.3) | B | A |
| Example 24 | Toner 24 | A (1.46) | B (0.10) | B (1.4) | B | A |
| Example 25 | Toner 25 | A (1.46) | B (0.12) | C (1.6) | B | A |
| Example 26 | Toner 26 | A (1.45) | B (0.13) | C (1.8) | C | A |
| Example 27 | Toner 27 | A (1.45) | A (0.05) | A (0.4) | A | A |
| Example 28 | Toner 28 | A (1.45) | A (0.08) | A (0.8) | A | A |
| Example 29 | Toner 29 | B (1.44) | B (0.14) | C (1.9) | B | B |
| Example 30 | Toner 30 | B (1.42) | C (0.18) | C (1.8) | B | C |
| Comparative Example 1 | Comparative Toner 1 | A (1.45) | C (0.18) | C (1.9) | D | C |
| Comparative Example 2 | Comparative Toner 2 | A (1.46) | C (0.17) | D (2.3) | D | D |
| Comparative Example 3 | Comparative Toner 3 | A (1.45) | D (0.23) | C (1.8) | D | D |
| Comparative Example 4 | Comparative Toner 4 | A (1.45) | C (0.19) | B (1.4) | D | C |
| Comparative Example 5 | Comparative Toner 5 | A (1.46) | B (0.14) | D (2.2) | D | C |
| Comparative Example 6 | Comparative Toner 6 | B (1.44) | D (0.23) | C (1.9) | D | D |
| Comparative Example 7 | Comparative Toner 7 | B (1.43) | D (0.21) | C (1.6) | D | C |
| Comparative Example 8 | Comparative Toner 8 | B (1.43) | D (0.24) | C (1.8) | D | C |
| Comparative Example 9 | Comparative Toner 9 | B (1.44) | C (0.15) | D (2.5) | C | A |
| Comparative Example 10 | Comparative Toner 10 | C (1.39) | C (0.19) | C (1.9) | D | D |
| Comparative Example 11 | Comparative Toner 11 | B (1.43) | D (0.21) | B (1.4) | D | C |
| Comparative Example 12 | Comparative Toner 12 | A (1.46) | B (0.13) | B (1.2) | D | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-131695, filed Jun. 24, 2013, and No. 2014-102124, filed May 16, 2014, which are hereby incorporated by reference herein in its entirety.

What is claimed is:

1. A toner comprising:

toner particles each comprising a binder resin and a colorant; and as external additives, inorganic fine particles A and inorganic fine particles B, wherein the inorganic fine particles A are group 2 element titanate fine particles, the group 2 element titanate fine particles have a number-average particle diameter (D1) of primary particles thereof, which is not less than 60 nm and not more than 200 nm, the inorganic fine particles B are silica fine particles, the silica fine particles have a number-average particle diameter (D1) of primary particles thereof, which is not less than 5 nm and not more than 20 nm, the silica fine particles have a coverage ratio X1 on surfaces of the toner particles, as determined with an x-ray photoelectron spectrometer (ESCA spectrometer), which is not less than 40.0 surface area % and not more than 75.0 surface area %, when the theoretical coverage ratio by the silica fine particles is X2, a diffusion index defined by Formula 1 below satisfies Formula 2 below:

$$\text{diffusion index}=X1/X2 \qquad \text{Formula 1}$$

$$\text{diffusion index}\geq -0.0042\times X1+0.62 \qquad \text{Formula 2}$$

and the external additives have an embedding ratio on the toner particles, which is not less than 25% and not more than 60%.

2. The toner according to claim 1, wherein the group 2 element titanate fine particles are strontium titanate fine particles.

3. The toner according to claim 1, wherein the toner particles have an average circularity of not less than 0.960.

4. The toner according to claim 1, wherein a ratio of group 2 element titanate fine particles that are free (free ratio) is not less than 20% and not more than 70%.

5. The toner according to claim 1, wherein the silica fine particles have a bulk density of not less than 15 g/L and not more than 50 g/L.

6. The toner according to claim 1, wherein the toner includes not less than 0.1 mass part and not more than 1.0 mass part of the group 2 element titanate fine particles per 100 mass parts of the toner particles.

7. The toner according to claim 1, wherein the toner particles are obtained by dispersing a polymerizable monomer composition comprising a polymerizable monomer and a colorant in an aqueous medium and effecting granulation, and then polymerizing the polymerizable monomer present in the particles formed by the granulation.

8. The toner according to claim 1, wherein the group 2 element titanate fine particles have a number-average particle diameter (D1) of primary particles thereof, which is not less than 80 nm and not more than 150 nm.

9. The toner according to claim 1, wherein the silica fine particles have a number-average particle diameter of primary particles thereof, which is not less than 5 nm and not more than 15 nm.

10. The toner according to claim 1, wherein the silica fine particles have a specific surface area, as measured by the BET method using nitrogen adsorption, of not less than 20 $m^2/g$ and not more than 350 $m^2/g$.

* * * * *